US008391755B2

(12) United States Patent
Nakagawa et al.

(10) Patent No.: US 8,391,755 B2
(45) Date of Patent: Mar. 5, 2013

(54) DEVELOPING DEVICE, PROCESS CARTRIDGE, AND IMAGE FORMING APPARATUS

(75) Inventors: Yoshinori Nakagawa, Kanagawa (JP); Yasuyuki Ishii, Tokyo (JP); Hideki Kosugi, Kanagawa (JP); Tomoko Takahashi, Kanagawa (JP); Masaaki Yamada, Tokyo (JP); Ichiro Kadota, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 1079 days.

(21) Appl. No.: 12/205,314

(22) Filed: Sep. 5, 2008

(65) Prior Publication Data

US 2009/0067889 A1 Mar. 12, 2009

(30) Foreign Application Priority Data

Sep. 12, 2007 (JP) ..... 2007-236272

(51) Int. Cl.
*G03G 15/08* (2006.01)

(52) U.S. Cl. ..... 399/266; 399/285; 399/289; 399/290; 399/291; 430/123.2

(58) Field of Classification Search ..... 399/266, 399/289–291; 430/123.2
See application file for complete search history.

(56) References Cited

U.S. PATENT DOCUMENTS 5,339,142 A * 8/1994 Hays ..... 399/253
5,568,230 A * 10/1996 Reddy et al. ..... 399/100
5,899,608 A * 5/1999 Eklund et al. ..... 399/266
6,023,600 A * 2/2000 Julien et al. ..... 399/266
6,223,013 B1 * 4/2001 Eklund et al. ..... 399/266
(Continued)

FOREIGN PATENT DOCUMENTS

JP 2004-198675 7/2004
JP 2004-333845 11/2004
(Continued)

OTHER PUBLICATIONS

U.S. Appl. No. 12/170,930, Jul. 10, 2008, Takahashi, et al.
(Continued)

*Primary Examiner* — David Gray
*Assistant Examiner* — Geoffrey Evans
(74) *Attorney, Agent, or Firm* — Oblon, Spivak, McClelland, Maier & Neustadt, L.L.P.

(57) ABSTRACT

A developing device constituted to be capable of reliably making toner flare, and carrying out developing normally in the developing area, by preventing toner from adhering to the toner carrier. A developing device having a toner carrier which is disposed in opposition to a latent image carrier and which carries toner for developing an electrostatic latent image on the latent image carrier, the developing device including: a plurality of electrodes aligned at a predetermined interval within the toner carrier; voltage application means for applying a voltage to the electrodes so that the electric field between the plurality of electrodes varies with time, wherein the electric field between the electrodes causes the toner on the toner carrier to hop and form a cloud; and a toner adhesion prevention member that is provided upstream of a developing area where the latent image carrier is in opposition to the toner carrier and that prevents adhesion of toner to the toner carrier. According to the developing device, it is possible to prevent toner from adhering to the toner carrier, and it is possible to make the toner flare reliably.

18 Claims, 19 Drawing Sheets

U.S. PATENT DOCUMENTS

| | | | | |
|---|---|---|---|---|
| 6,658,227 | B2 | 12/2003 | Oyama et al. | |
| 6,721,534 | B2 | 4/2004 | Takahashi | |
| 6,856,780 | B2 | 2/2005 | Kadota et al. | |
| 6,901,231 | B1 | 5/2005 | Sakai et al. | |
| 7,024,142 | B2 | 4/2006 | Sakai et al. | |
| 7,200,352 | B2 | 4/2007 | Sakai et al. | |
| 7,308,222 | B2 | 12/2007 | Nakagawa et al. | |
| 7,412,190 | B2 | 8/2008 | Kadota et al. | |
| 8,116,667 | B2 * | 2/2012 | Ozaki et al. | 399/266 |
| 8,158,313 | B2 * | 4/2012 | Tsukamoto et al. | 430/45.1 |
| 8,165,510 | B2 * | 4/2012 | Kadota et al. | 399/266 |
| 8,259,142 | B2 * | 9/2012 | Hirota et al. | 347/151 |
| 2003/0068166 | A1 * | 4/2003 | Hirsch et al. | 399/30 |
| 2005/0002054 | A1 | 1/2005 | Shoji et al. | |
| 2006/0088337 | A1 * | 4/2006 | Nakazato et al. | 399/116 |
| 2006/0210320 | A1 * | 9/2006 | Nakagawa et al. | 399/265 |
| 2006/0216071 | A1 | 9/2006 | Yamada et al. | |
| 2006/0251449 | A1 | 11/2006 | Takahashi et al. | |
| 2007/0013924 | A1 | 1/2007 | Sakai et al. | |
| 2007/0015071 | A1 | 1/2007 | Tsukamoto et al. | |
| 2007/0025775 | A1 | 2/2007 | Takahashi et al. | |
| 2007/0086811 | A1 | 4/2007 | Tsukamoto et al. | |
| 2007/0160395 | A1 | 7/2007 | Kosugi et al. | |
| 2007/0212121 | A1 | 9/2007 | Takahashi et al. | |
| 2007/0242985 | A1 | 10/2007 | Aoki et al. | |
| 2008/0089720 | A1 | 4/2008 | Tsukamoto et al. | |
| 2008/0089723 | A1 | 4/2008 | Tsukamoto et al. | |
| 2008/0124138 | A1 | 5/2008 | Kosugi et al. | |
| 2009/0035025 | A1 * | 2/2009 | Ishii et al. | 399/266 |
| 2010/0021214 | A1 * | 1/2010 | Kadota et al. | 399/266 |
| 2012/0057891 | A1 * | 3/2012 | Ishikura et al. | 399/55 |
| 2012/0063797 | A1 * | 3/2012 | Hirota et al. | 399/55 |
| 2012/0063815 | A1 * | 3/2012 | Seki et al. | 399/265 |
| 2012/0063816 | A1 * | 3/2012 | Yamashita et al. | 399/266 |
| 2012/0134721 | A1 * | 5/2012 | Abe et al. | 399/265 |

FOREIGN PATENT DOCUMENTS

| | | |
|---|---|---|
| JP | 2005-10348 | 1/2005 |

OTHER PUBLICATIONS

U.S. Appl. No. 12/205,240, Sep. 5, 2008, Takahashi, et al.

* cited by examiner

DEVELOPING DEVICE, PROCESS CARTRIDGE, AND IMAGE FORMING APPARATUS

BACKGROUND OF THE INVENTION

1. Field of the Invention

The present invention relates to a developing device that develops electrostatic latent images on a latent image carrier using toner, a process cartridge provided with the developing device, and an image forming apparatus such as a copier, printer, plotter, facsimile machine, or a multi-function machine that combines these functions, that is provided with the developing device or the process cartridge.

2. Description of the Related Art

As the conventional technology of developing devices that develop electrostatic latent images on an image carrier using toner, Japanese Patent Application Laid-open No. 2005-010348 (Prior Art 1), for example, discloses a developing device that develops electrostatic latent images in a non-contact manner by transferring toner from a donor structure to a charge carrying surface. The developing device includes an electrode provided between the donor structure and the charge carrying surface close to the donor structure, first application means for applying a first alternating voltage to the electrode, and second application means for applying a third alternating voltage, which is a super position of the first alternating voltage and a second alternating voltage that is substantially synchronous with the first alternating voltage, to the donor structure.

Also, Japanese Patent Application Laid-open No. 2004-333845 (Prior Art 2) discloses a developing device having developing agent transport means for transporting developing agent. In the developing agent transport means, a non-uniform alternating electric field is formed by applying a multi-layered alternating voltage to a plurality of electrodes arranged in an array at predetermined intervals. Electrostatic latent images are made visible by the developing agent transport means transporting developing agent to an image carrier on which the electrostatic latent images are formed. The developing agent transport means is constituted so that the distance from the surface of each electrode to the developing agent transport surface becomes significantly shorter in the direction of transport of the developing agent.

Also, Japanese Patent Application Laid-open No. 2004-198675 (Prior Art 3) discloses a developing device that develops latent images on a latent image carrier by causing powder to adhere to the latent image carrier. The developing device includes a transport member having a plurality of electrodes disposed in opposition to the latent image carrier that generate a progression wave electric field to move the powder. An n phase voltage is applied to the electrodes of the transport member to form an electric field that moves the powder in the direction of the latent image carrier at the image parts of the latent image, and moves the powder in the opposite direction to the latent image carrier at the non-image parts.

Conventionally, developing devices are known that develop by supplying developing agent to a latent image carrier, without allowing the developing agent on a developing agent carrier to directly contact the latent image carrier. An example of this is the conventional technology in which toner is supplied to the latent image carrier by making the toner on a toner carrier form a cloud. The toner carrier is disposed in opposition to the latent image carrier, and a plurality of electrodes is arranged at a predetermined pitch within the toner carrier. Time-varying voltages are applied to the plurality of electrodes, and the electric field between the electrodes causes the toner on the toner carrier to fly (called "flare" herein after) and form a cloud.

In a developing device constituted in this way, the relative magnitude of the force F1 on the toner on the surface of the toner carrier due to the electric field between the electrodes and the adhesion force F2 between the toner and the toner carrier surface is important. If F1 is greater than F2, the toner can flare properly in accordance with the electric field between the electrodes. However, if F1 is smaller than F2, the toner stays adhering to the toner carrier surface and cannot flare, so developing does not occur properly.

Therefore it is necessary for F1 to be greater than F2 for developing to occur properly. To increase F1 there are various possible methods, such as increasing the value of the voltage applied to the electrodes, or making the thickness of the insulating layer covering the surface of the electrodes thinner, and so on. By these methods F1 is made larger than F2 so that flaring occurs properly.

However, if the toner is not used very much for developing and is continuously agitated within the developing device for a long period of time, external additive that was on the surface layer of the toner matrix becomes removed, or becomes embedded within the matrix, and the percentage of the external additive on the surface layer becomes reduced. If toner in this state adheres to the surface of the toner carrier, the toner matrix comes into direct contact with the surface of the toner carrier, the contact distance becomes smaller, and the contact area becomes larger. In this type of situation the non-electrostatic adhesion forces between the toner and the surface of the toner carrier increase. Also, even if the amount of charge on the toner does not vary with time, the image forces on the toner from the toner carrier surface due to the toner charge increases. Therefore, for toner that has degraded with time as the percentage of external additive is reduced, the adhesion force F2 between the toner and the toner carrier surface increases greatly. When the force F2 becomes greater than the force F1 on the toner due to the electric field between the electrodes, flaring of the toner does not occur.

When flaring ceases to occur because of degradation of the toner with time, increasing the value of the voltage applied to the electrodes to increase the force F1 on the toner from the electric field between the electrodes can be considered. In this case F1 can be made larger than F2, but toner that flares because of the large force from the electric field cannot return to the toner carrier, so dispersal of the toner occurs. Also, the voltage is applied by applying a large potential difference between electrodes, so the possibility for the occurrence of leakage between electrodes becomes larger.

If F2 becomes larger than F1 overtime, it is possible to provide an opposing electrode in opposition to the toner carrier, and by applying a voltage to the electrode so that an electric field is produced that impels the toner from the toner carrier towards the opposing electrode, F1 can be increased. This is the same in principle as increasing the voltage applied to the electrodes of the toner carrier, but in the case of the opposing electrode the dispersed toner is collected on the opposing electrode, so there is no problem. Also, toner that has flared does not subsequently adhere to the toner carrier surface, so the opposing electrode should be only provided at a part of the toner carrier.

Also, F2 can be made smaller by physically moving toner that has adhered for a long time, and by doing so F2 can be made smaller than F1. Flared toner continues hopping between the electrodes, but when toner that is hopping impacts adhering toner, the adhering toner is moved, F2 becomes smaller, and flaring starts. In this way toner starts flaring like an avalanche, and ultimately all the toner on the toner carrier becomes flared.

In the conventional technology disclosed in Prior Art 1, electrodes are provided in the developing area between the donor structure and the charge retention surface. A voltage that is a super position of alternating current voltages is applied to the electrodes, and the toner on the donor structure forms a cloud. In a developing device with this type of constitution, when the toner degrades with time so that the adhesion force with the donor structure increases, it is necessary to apply a large voltage to the electrodes in order to make the toner form a cloud. In this case, it is possible that the toner in cloud form will adhere to the charge retention surface, and this has the problem that contamination is caused. Also, there is the possibility that the developed toner image will be disturbed by the toner that was once retained on the charge retention surface, so image degradation will occur.

In the conventional technology disclosed in Prior Art 2, the electric field on the surface of the developing agent transport means is gradually increased by reducing the width of the insulation layer on the electrodes of the developing agent transport means as the developing area is approached, so the toner forms a high cloud in the image area. In a developing device with this type of constitution, when toner has degraded with time it adheres to the surface of the developing agent transport means before arriving at the developing area, so the adhering toner is not transported into the developing area. Therefore, if most of the toner adheres, it will affect the toner that comes subsequently, which is a problem.

SUMMARY OF THE INVENTION

With the foregoing in view, it is an object of the present invention to provide a developing device constituted so as to be capable of causing the toner to flare properly, and properly carry out developing in the developing area, by preventing adhesion of toner to the toner carrier.

Also, it is an object of the present invention to provide an image forming apparatus and process cartridge that includes this developing device, and further it is an object to provide an image forming apparatus that includes the process cartridge.

In an aspect of the present invention, a developing device has a toner carrier which is disposed in opposition to a latent image carrier and which carries toner for developing an electrostatic latent image on the latent image carrier. The developing device comprises a plurality of electrodes aligned at predetermined intervals within the toner carrier; a voltage application device for applying a voltage to the electrodes so that the electric field between the plurality of electrodes varies with time, wherein the electric field between the electrodes causes the toner on the toner carrier to hop and form a cloud; and a toner adhesion prevention member that is provided upstream of a developing area where the latent image carrier is in opposition to the toner carrier and that prevents adhesion of toner to the toner carrier.

In another aspect of the present invention, an image forming apparatus forms an image by developing a latent image on a latent image carrier by causing toner to adhere to the latent image, and finally transfers a toner image obtained in this development process to a recording material. The image forming apparatus comprises a developing device for developing the latent image on the latent image carrier. The developing device has a toner carrier which is disposed in opposition to a latent image carrier and which carries toner for developing an electrostatic latent image on the latent image carrier, and comprises a plurality of electrodes aligned at predetermined intervals within the toner carrier; a voltage application device for applying a voltage to the electrodes so that the electric field between the plurality of electrodes varies with time, wherein the electric field between the electrodes causes the toner on the toner carrier to hop and form a cloud; and a toner adhesion prevention member that is provided upstream of a developing area where the latent image carrier is in opposition to the toner carrier and that prevents adhesion of toner to the toner carrier.

In another aspect of the present invention, a process cartridge is mounted on an image forming apparatus that forms an image by the electrophotographic process. At least one of a latent image carrier, a charging means, and a cleaning device is supported integrally with a developing device, and the process cartridge is capable of being attached to and removed from the image forming apparatus. The developing device has a toner carrier which is disposed in opposition to a latent image carrier and which carries toner for developing an electrostatic latent image on the latent image carrier. The developing device comprises: a plurality of electrodes aligned at predetermined intervals within the toner carrier; a voltage application device for applying a voltage to the electrodes so that the electric field between the plurality of electrodes varies with time, wherein the electric field between the electrodes causes the toner on the toner carrier to hop and form a cloud; and a toner adhesion prevention member that is provided upstream of a developing area where the latent image carrier is in opposition to the toner carrier and that prevents adhesion of toner to the toner carrier.

In another aspect of the present invention, an image forming apparatus forms an image by the electrophotographic process and comprises one or a plurality of process cartridges to form a monochrome, multi-color, or full color image. The process cartridge is mounted on the image forming apparatus, has at least one of a latent image carrier, a charging device, and a cleaning device supported integrally with a developing device, and is capable of being attached to and removed from the image forming apparatus. The developing device has a toner carrier which is disposed in opposition to a latent image carrier and which carries toner for developing an electrostatic latent image on the latent image carrier, and comprises: a plurality of electrodes aligned at predetermined intervals within the toner carrier; a voltage application device for applying a voltage to the electrodes so that the electric field between the plurality of electrodes varies with time. The electric field between the electrodes causes the toner on the toner carrier to hop and form a cloud; and a toner adhesion prevention member that is provided upstream of a developing area where the latent image carrier is in opposition to the toner carrier and that prevents adhesion of toner to the toner carrier.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT(s)

The following is a detailed explanation of the embodiments and examples of the present invention, with reference to the drawings.

Embodiment 1

Figure 1:
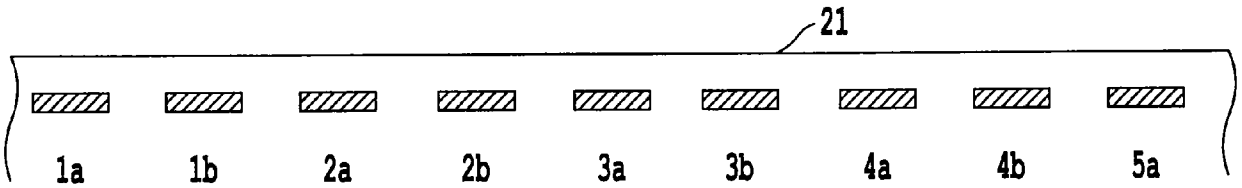
FIG. 1 is a cross-section diagram showing an example of the constitution of the electrodes of the toner carrier used in the developing device according to the present invention.
Figure 2:
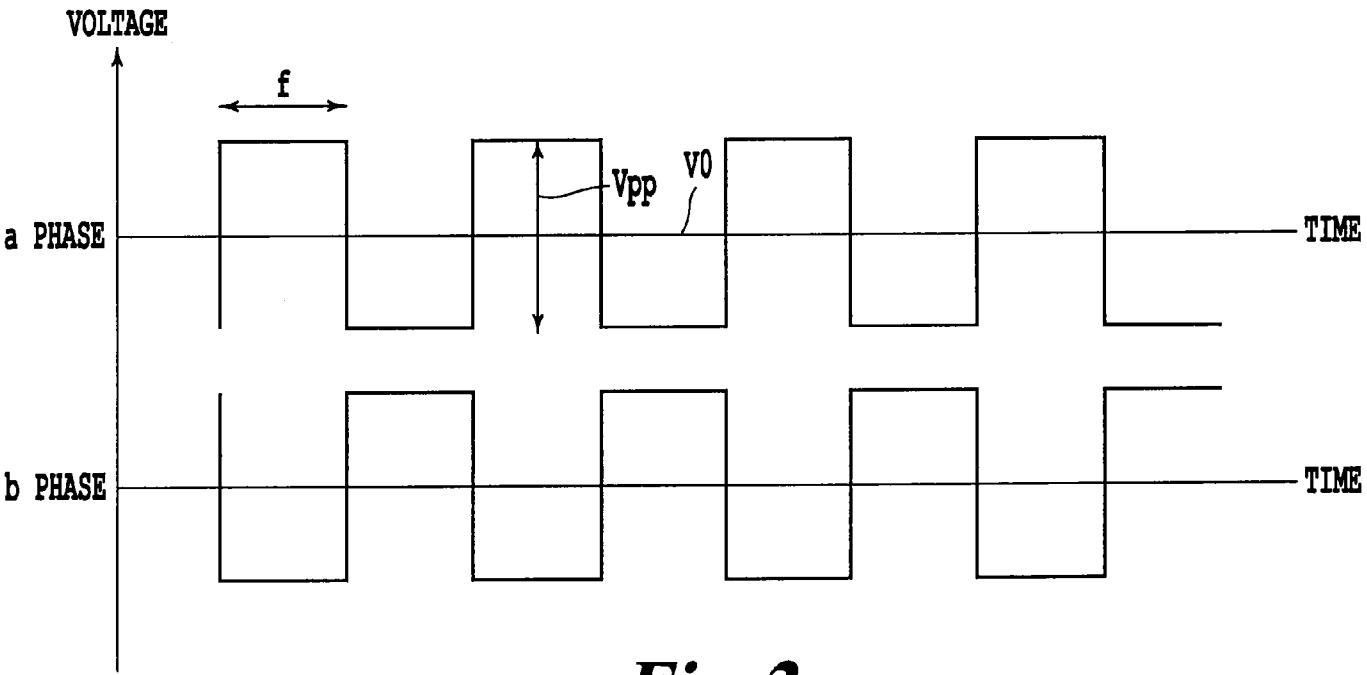
FIG. 2 is a diagram showing an example of the voltage applied to the a phase and b phase of the toner carrier shown in FIG. 1.
Figure 3:
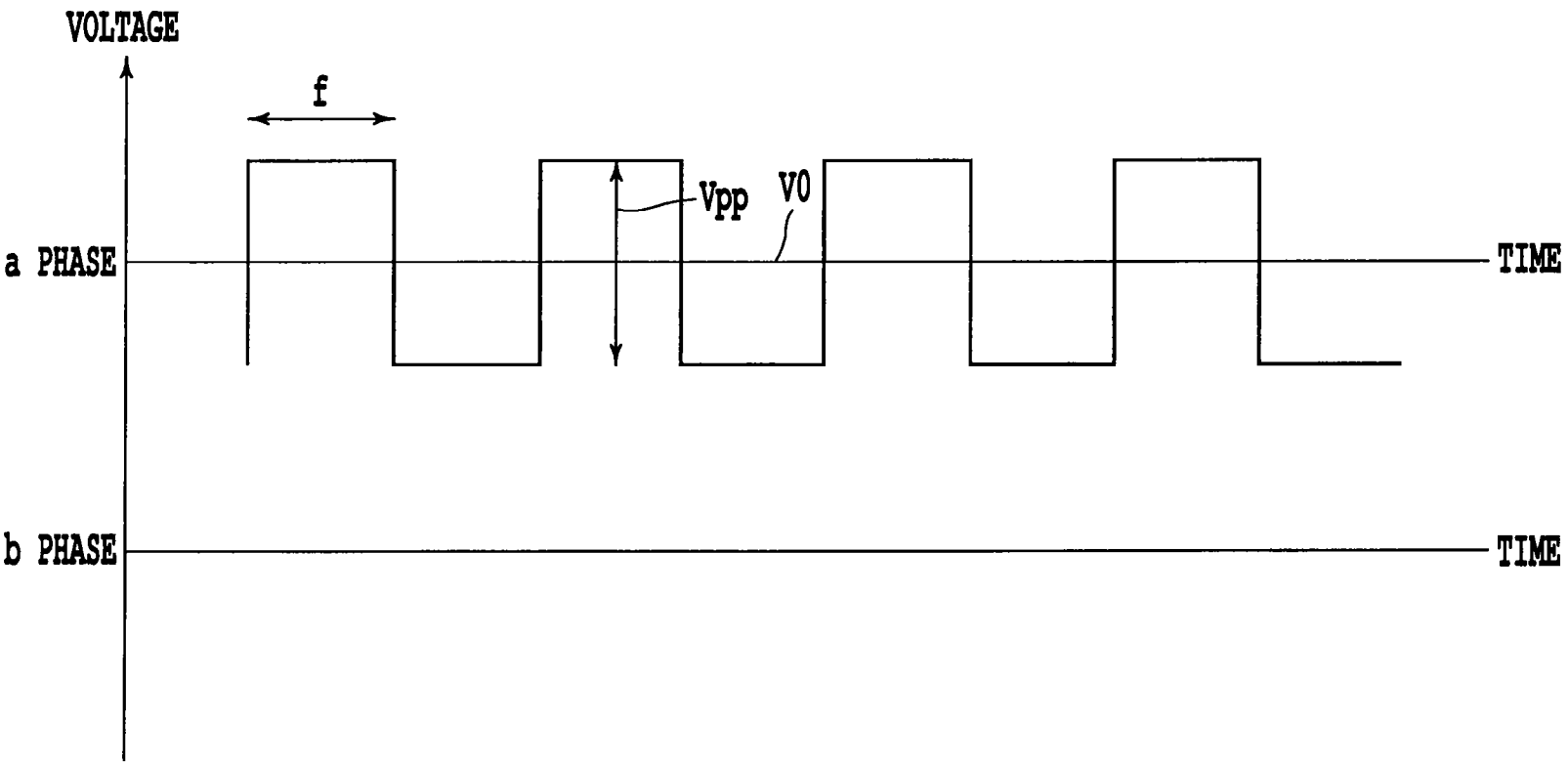
FIG. 3 is a diagram showing another example of the voltage applied to the a phase and b phase of the toner carrier shown in FIG. 1.

FIG. 1 shows an example of the constitution of the electrodes of the toner carrier used in a developing device according to the present embodiment. In the constitution in FIG. 1, the width of electrodes of a toner carrier 21 is 40 μm, and the distance between electrodes is 40 μm. Also, the electrodes of the toner carrier 21 are two phase, the odd numbered electrodes 1*a*, 2*a*, 3*a*, 4*a*, 5*a*, . . . are the a phase, and the even numbered electrodes 1*b*, 2*b*, 3*b*, 4*b*, 5*b*, . . . are the b phase. FIGS. 2 and 3 show examples of the voltage applied to the a phase and b phase of the electrodes of the toner carrier 21.

In FIG. 2, the voltage is a rectangular wave, with the voltages of the a phase and b phase applied with their phases shifted by π. As a result of this phase difference there is always a potential difference of Vpp between the a phase and the b phase. An electric field is generated between the electrodes by this potential difference, and the toner is made to hop between the electrodes by the electric field. Vpp is in the region 100V to 1000V. If Vpp is smaller than 100V, the electric field between the electrodes becomes smaller, so the toner does not hop. Also, if Vpp is greater than 1000V, it is possible that leaks will occur between the electrodes with time. If leaks occur, thereafter electric fields will not be generated between the electrodes, and the toner will not be made to hop.

The frequency f of the rectangular wave of the applied voltage is in the range 0.1 kHz to 10 kHz. If the frequency is less than 0.1 kHz the hopping of the toner cannot keep up with the developing speed. Also, if the frequency is higher than 10 kHz, the toner cannot follow the switching of the voltage. The central value of the voltage V0 is between the voltage of the image parts and the voltage of the non-image parts, and is varied in accordance with the developing conditions. In FIG. 2, the applied voltage is a rectangular wave. With a rectangular wave the voltage switches instantaneously, so it is suitable for hopping of toner, but a sine wave or a triangular wave may also be used.

FIG. 3 is an example of another method of application of the voltage. A rectangular wave is applied to the a phase, the same as in FIG. 2, but a direct current voltage is applied to the b phase. In this case, the potential difference between electrodes is Vpp/2. Therefore the applied voltage Vpp in the case of FIG. 3 is in the range 200V to 2000V. In the method of application in FIG. 3 it is not necessary to consider the potential difference between phase a and phase b, so the power supply cost becomes cheaper.

Figure 4:
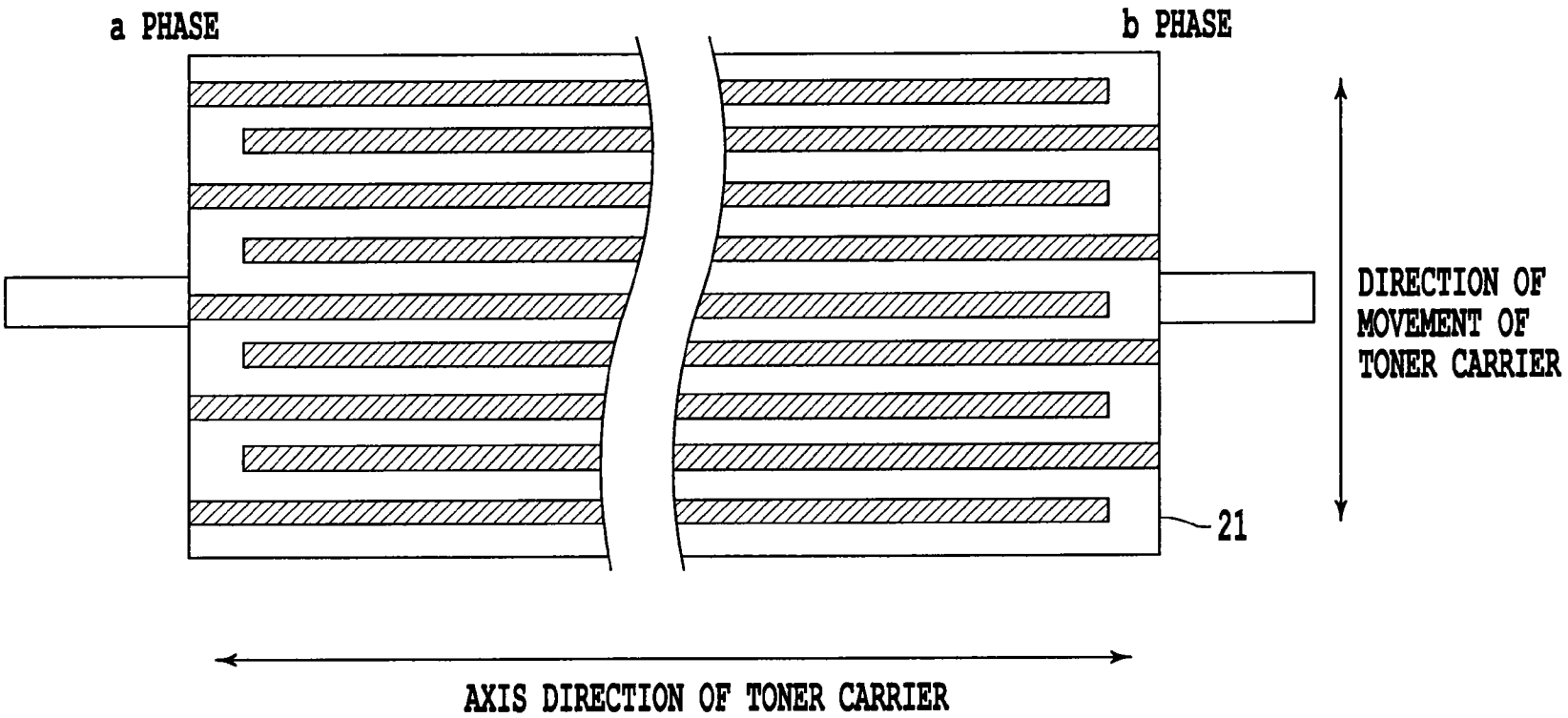
FIG. 4 is a diagram viewed from the direction parallel to the axis of the toner carrier shown in FIG. 1.

FIG. 4 is a diagram viewed from the direction parallel to the axis of the toner carrier 21. In FIG. 4, the a phase electrodes protrude from the left hand side of the toner carrier 21, and the b phase electrodes protrude from the right hand side of the toner carrier 21. The toner carrier 21 is constituted in the shape of the teeth of a comb with the a phase and the b phase electrodes. Also, the two end portions of the toner carrier 21 are constituted so that a voltage can be supplied from outside. Examples include brush-shaped electrodes connected to a power supply in sliding contact with the two ends of the toner carrier 21, and other methods of supplying voltage.

The toner carrier 21 can be made by coating a metal roller made from stainless steel or similar that forms a shaft with resin, or pressing a metal roller into a resin roller, and forming the electrodes in the shape of teeth of a comb on the surface of the resin roller. Then, after the electrodes have been formed, the surface is coated with an insulating layer, to complete the toner carrier 21.

Figure 5:
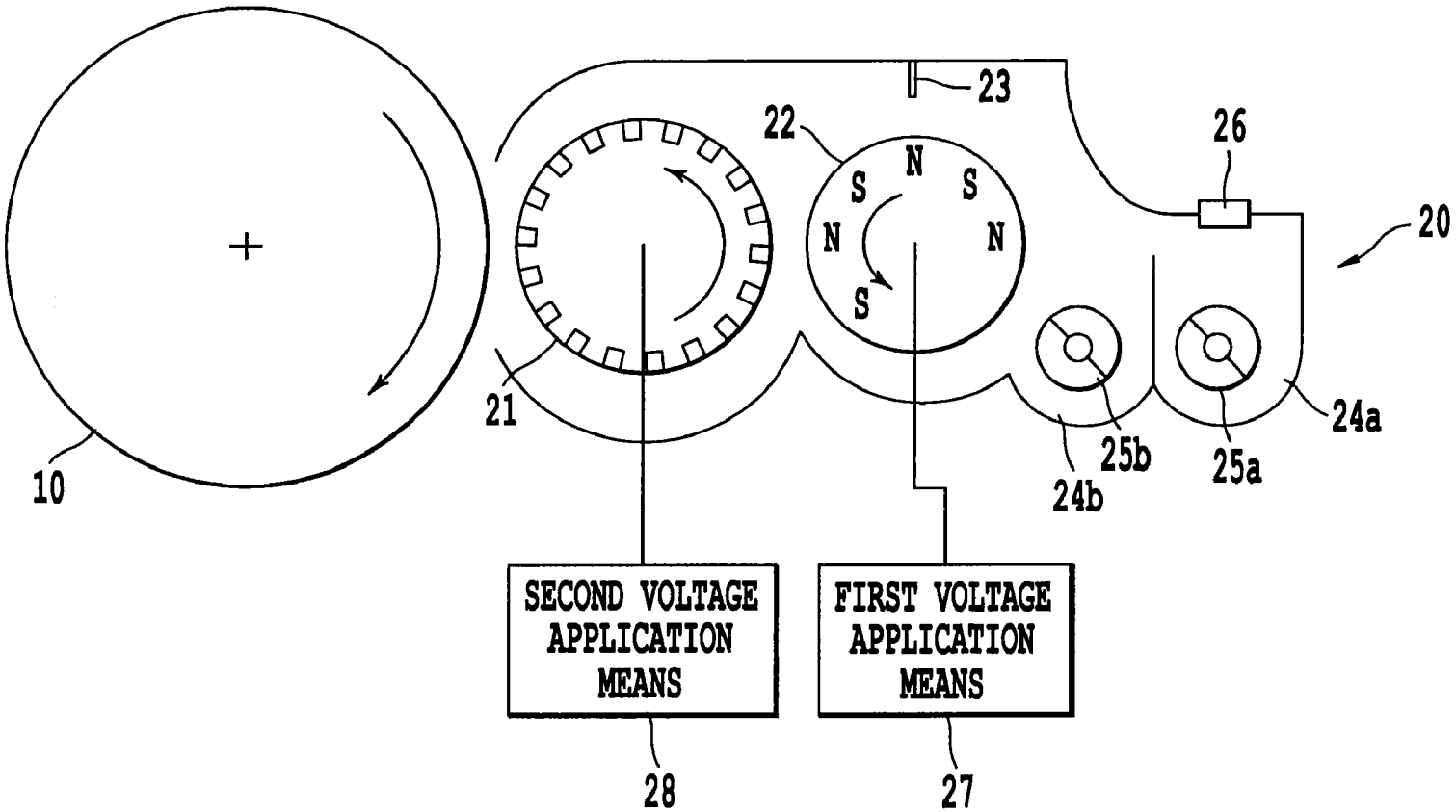
FIG. 5 is a diagram showing the schematic constitution of a developing device according to the first embodiment of the present invention.

FIG. 5 is a diagram showing the schematic constitution of a developing device according to the first embodiment of the present invention. The developing device 20 shown in FIG. 5 is an example that uses two-component developing agent made from magnetic carrier and non-magnetic toner. A developing agent housing unit shown in FIG. 5 is divided into two compartments 24*a*, 24*b*, connected by developing agent passages (not shown on the drawings) at both ends within the developing device. Two-component developing agent is housed within the developing agent housing unit 24*a*, 24*b*, and is transported and agitated within the developing agent housing unit by agitation and transport screws 25*a*, 25*b* in each compartment. The developing device 20 includes a toner replenishment aperture 26, and toner is supplied from a toner housing unit (not shown on the drawings) to the developing agent housing unit 24*a* via the toner replenishment aperture 26. A toner concentration sensor (not shown in the drawings) that measures magnetic permeability is disposed in the developing agent housing unit (24*a* or 24*b*), to measure the concentration of the toner. When the concentration of toner in the developing agent housing unit (24*a* or 24*b*) is reduced, toner is supplied from the toner replenishment aperture 26 to the developing agent housing unit.

A toner supply member (developing agent carrier) 22 is disposed in a position in opposition to the agitation and transport screw 25*b*. Fixed magnets are disposed within the toner supply member 22, and developing agent within the developing agent housing unit is scooped up onto the surface of the toner supply member 22 by the rotation of the toner supply member 22 and the magnetic force. A developing agent layer control member 23 is provided at a position in opposition to the toner supply member 22 downstream of the position where the developing agent is scooped up in the direction of rotation of the toner supply member 22. The developing agent scooped up at the scooping up position is regulated to a constant developing agent layer thickness by the developing agent layer control member 23. The developing agent that has passed the developing agent layer control member 23 is transported by the rotation of the toner supply member 22 to a position in opposition to the toner carrier 21 with the electrode constitution as described previously.

A supply bias is applied to the toner supply member 22 by first voltage application means 27. This supply bias may be a direct current voltage or an alternating current voltage. Also, the bias may be an alternating current voltage super imposed on a direct current voltage. At the position in opposition to the toner supply member 21, an electric field is generated between the toner carrier 21 and the toner supply member 22 by the first voltage application means 27 and second voltage application means 28. The toner is affected by the electrostatic force of the electric field, separates from the carrier, and is transferred to the surface of the toner carrier 21. A voltage is applied to the electrodes of the toner carrier 21 by the second voltage application means 28. The voltage applied by the second voltage application means 28 is preferably a rectangular wave as shown in FIG. 2 (or in FIG. 3), but a sine wave or a triangular wave may also be used.

In the present embodiment, the electrodes have two phases, the a phase and the b phase, and the voltages applied to adjacent electrodes have a phase difference of π, which causes an electric field between the electrodes. The toner that has arrived on the surface of the toner carrier 21 makes a reciprocating hopping motion between the electrodes due to the electric field between the electrodes. In the present embodiment, toner is transported as a result of rotation of the toner carrier 21. The toner is transported to the developing area by the rotation of the toner carrier 21 while making the reciprocating hopping motion between the electrodes. The toner transported to the developing area is developed on a latent image carrier 10 by a developing electric field between the toner carrier 21 and image parts on the latent image carrier 10. The toner that did not contribute to developing is transported further by the rotation of the toner carrier 21 while hopping, and is recovered from the surface of the toner carrier 21 surface by recovery means (not shown in the drawings). The recovered toner is returned to the developing agent housing unit 24*a*, 24*b* again, and circulated within the developing device 20.

Embodiment 2

Figure 6:
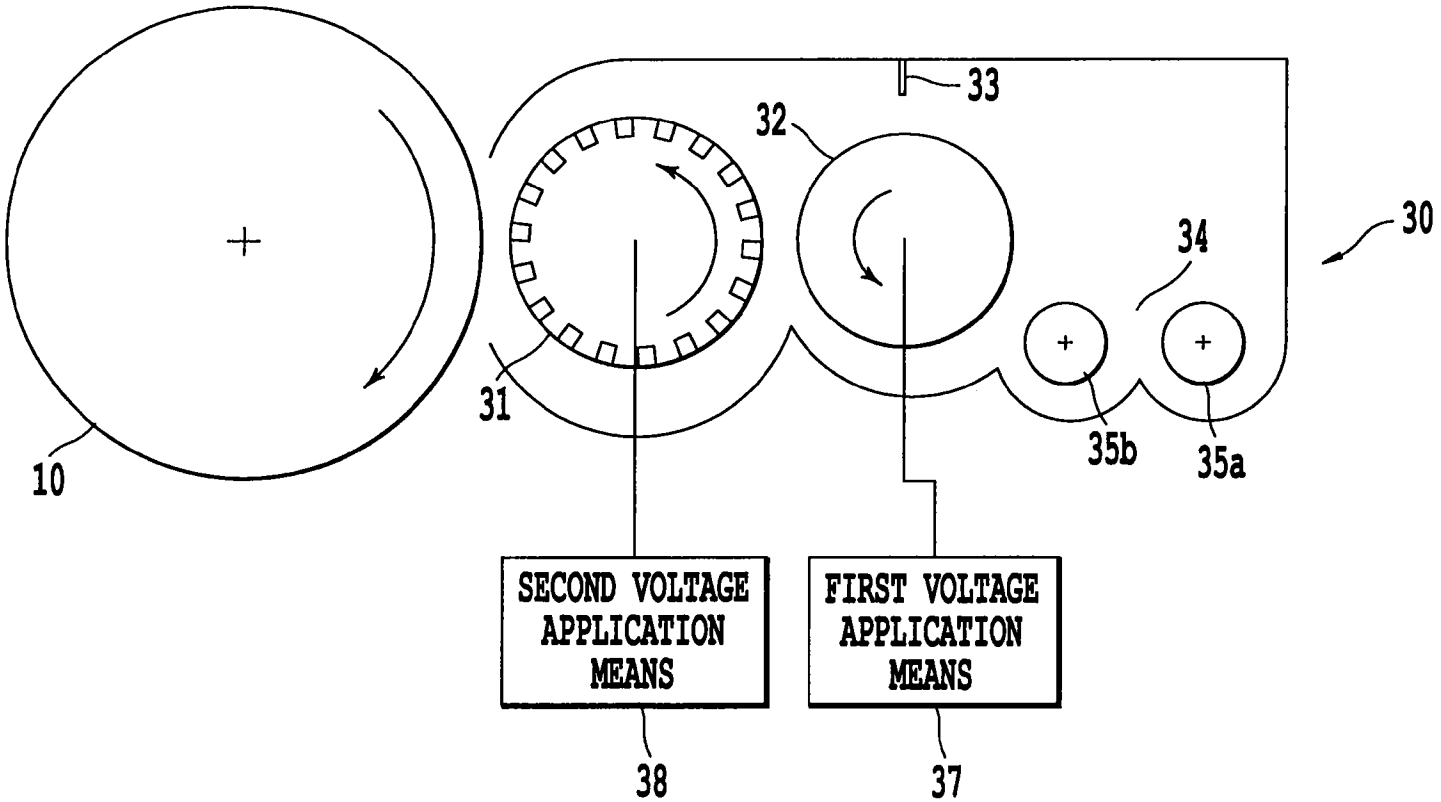
FIG. 6 is a diagram showing the schematic constitution of a developing device according to the second embodiment of the present invention.

Next, FIG. 6 is a diagram showing the schematic constitution of a developing device according to the present embodiment. An example of a developing device 30 is shown that uses one-component developing agent made from non-magnetic toner. The toner is housed in a developing agent housing unit 34, and is agitated by toner replenishment rollers 35*a*, 35*b*. Through the action of the toner replenishment roller 35*b*, the toner is becomes electrostatically charged by friction with a toner supply member 32. The toner is scooped up onto the toner supply member 32 by the electrostatic force. The toner on the toner supply member 32 is reduced to a thin layer by a developing agent layer control member 33. The toner is transported by the rotation of the toner supply member to a position in opposition to a toner carrier 31 having the electrode constitution as described previously.

A supply bias is applied to the toner supply member 32 by first voltage application means 37. The supply bias may be either a direct current voltage or an alternating current voltage. Also, the bias may be an alternating current voltage super imposed on a direct current voltage. At the position in opposition to the toner carrier 31, an electric field is formed between the toner carrier 31 and the toner supply member 32 by the first voltage application means 37 and a second voltage application means 38. The toner is affected by the electrostatic force from the electric field, separates from the toner supply member 32, and is transferred to the surface of the toner carrier 31. A voltage is applied to the toner carrier 31 by the second voltage application means 38. The voltage applied by the second voltage application means 38 is preferably a rectangular wave as shown in FIG. 2 (or in FIG. 3), but a sine wave or a triangular wave may also be used.

In the present embodiment, the electrodes have two phases, the a phase and the b phase, and the voltage applied to adjacent electrodes have a phase difference of π, which causes an electric field between the electrodes. The toner that has arrived on the surface of the toner carrier 31 makes a reciprocating hopping motion between the electrodes due to the electric field between the electrodes. In the present embodiment, toner is transported as a result of rotation of the toner carrier 31. The toner is transported to the developing area by the rotation of the toner carrier 31 while making the reciprocating hopping motion between the electrodes. The toner transported to the developing area is developed on a latent image carrier 10 by a developing electric field between the toner carrier 31 and image parts on the latent image carrier 10. The toner that did not contribute to developing is transported further by the rotation of the toner carrier 31 while hopping, and is recovered from the surface of the toner carrier surface by recovery means (not shown in the drawings). The recovered toner is returned to the developing agent housing unit 34 again, and circulated within the developing device 30.

Embodiment 3

Figure 7:
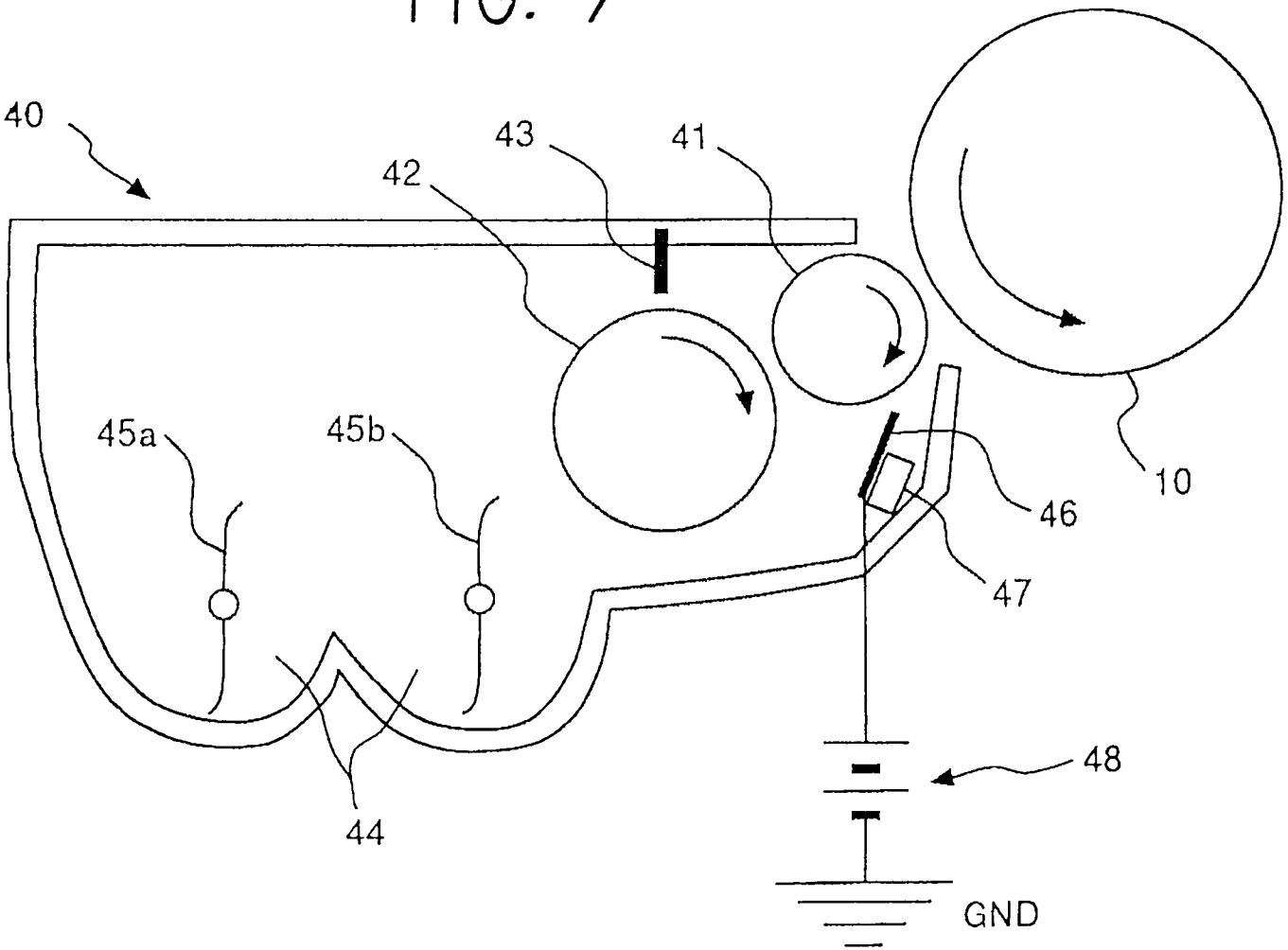
FIG. 7 is a diagram showing the schematic constitution of a developing device according to the third embodiment of the present invention.

FIG. 7 is a diagram showing the schematic constitution of a developing device according to the present embodiment. An example of a developing device 40 having toner recovery means disposed on the downstream side of the developing area relative to the direction of transport of the toner is shown. In FIG. 7, reference numeral 41 is a toner carrier, 42 is a toner supply member (or a developing agent carrier), and 43 is a developing agent layer control member. These members are the same as the constituent members of developing device shown in FIG. 5 or FIG. 6, and their operation is also the same. Also, reference numerals 45*a*, 45*b* are agitation and transport members.

Various methods may be considered for the toner recovery means. FIG. 7 shows toner recovery using a recovery plate 46 and a vibrator 47. A direct current voltage is applied between the toner carrier 41 and the recovery plate 46 by voltage application means 48, that generates an electric field so that a force acts to impel the toner in the direction from the toner carrier 41 to the recovery plate 46. In the recovery area where the recovery plate 46 is in opposition to the toner carrier 41, the toner that has not contributed to developing is transferred from the toner carrier 41 to the recovery plate 46. When a certain quantity of toner has accumulated on the recovery plate 46, the recovery plate 46 is vibrated by the vibrator 47, so the toner on the recovery plate 46 is shaken off and returned again to the developing agent housing unit 44.

Embodiment 4

Figure 8:
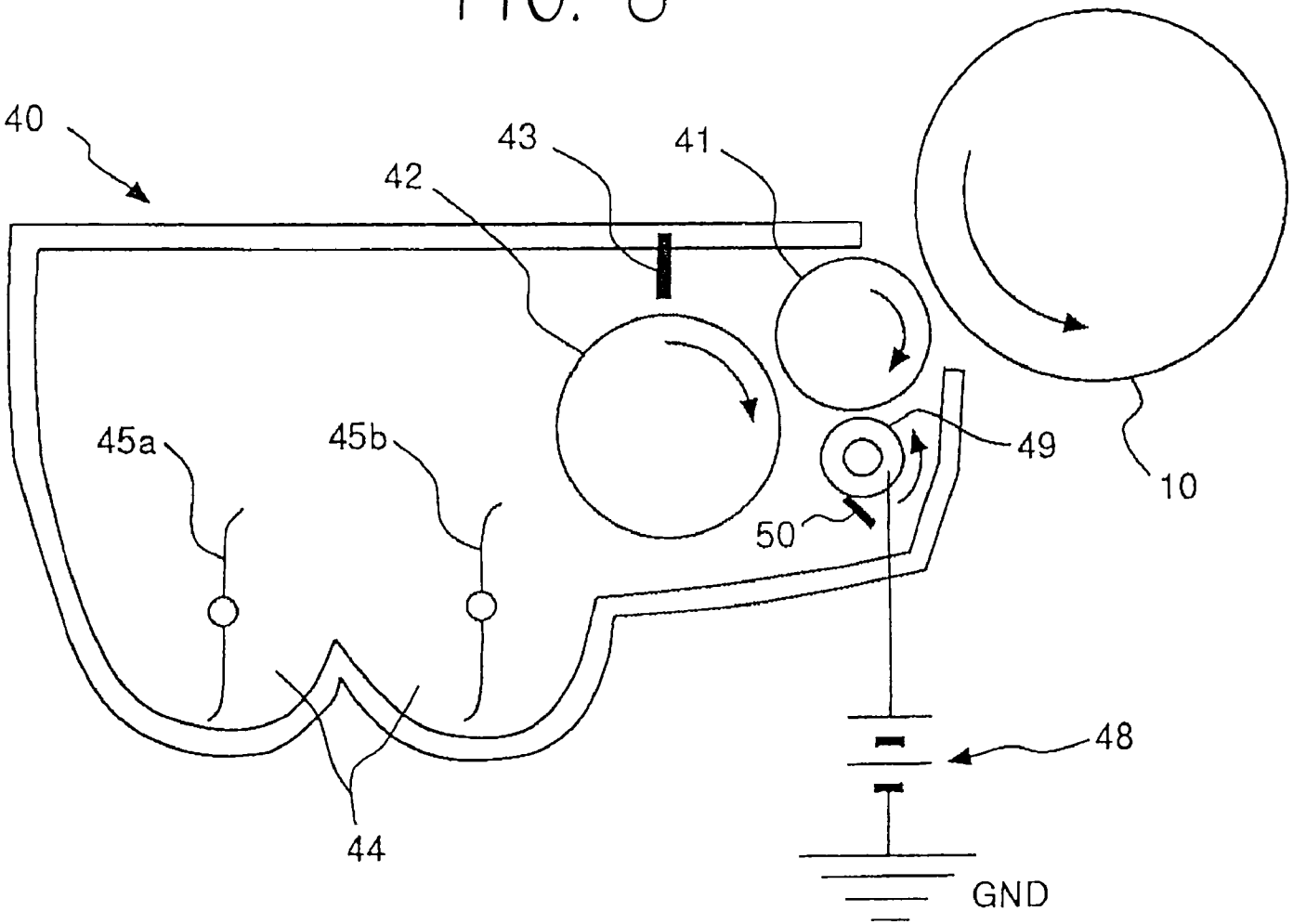
FIG. 8 is a diagram showing the schematic constitution of a developing device according to the fourth embodiment of the present invention.

Next, FIG. 8 is a diagram showing the schematic constitution of a developing device according to the present embodiment. An other example of a developing device having toner recovery means disposed on the down streamside of the developing area relative to the direction of transport of the toner is shown. In a developing device 40 shown in FIG. 8, toner is recovered using a recovery roller 49 as the toner recovery means. A direct current voltage is applied between a toner carrier 41 and the recovery roller 49 by voltage application means 48, that generates an electric field so that a force acts to impel the toner in the direction from the toner carrier 41 to the recovery roller 49. In the recovery area where the recovery roller 49 is in opposition to the toner carrier 41, the toner that has not contributed to developing is transferred from the toner carrier 41 to the recovery roller 49. Toner adhering to the recovery roller 49 is scraped off by a blade 50, and returned again to the developing agent housing unit 44.

Embodiment 5

Figure 9:
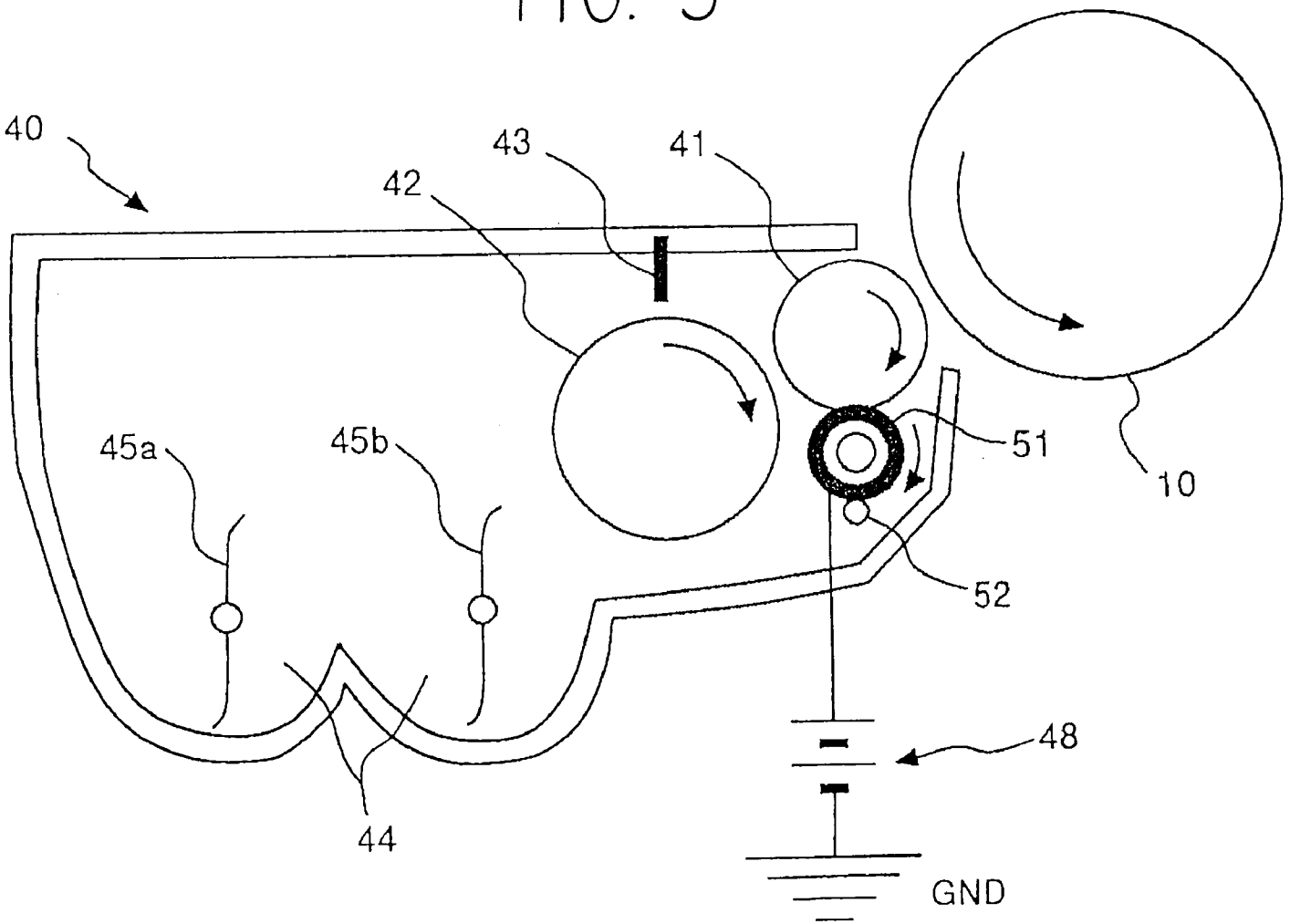
FIG. 9 is a diagram showing the schematic constitution of a developing device according to the fifth embodiment of the present invention.

Next, FIG. 9 is a diagram showing the schematic constitution of a developing device according to the present embodiment. Still another example of a developing device having toner recovery means disposed on the downstream side of the developing area relative in the direction of transport of the toner is shown. In a developing device 40 shown in FIG. 9, toner is recovered using a brush roller 51 as the toner recovery means. A direct current voltage is applied between a toner carrier 41 and the brush roller 51 by voltage application means 48, that generates an electric field so that a force acts to impel the toner in the direction from the toner carrier 41 to the brush roller 51. In the recovery area where the brush roller 51 is in opposition to the toner carrier 41, the toner that has not contributed to developing is transferred from the toner carrier 41 to the brush roller 51. Toner adhering to the brush roller 51 is scraped off by a flicker bar 52, and returned again to the developing agent housing unit 44.

Embodiment 6

Figure 10:
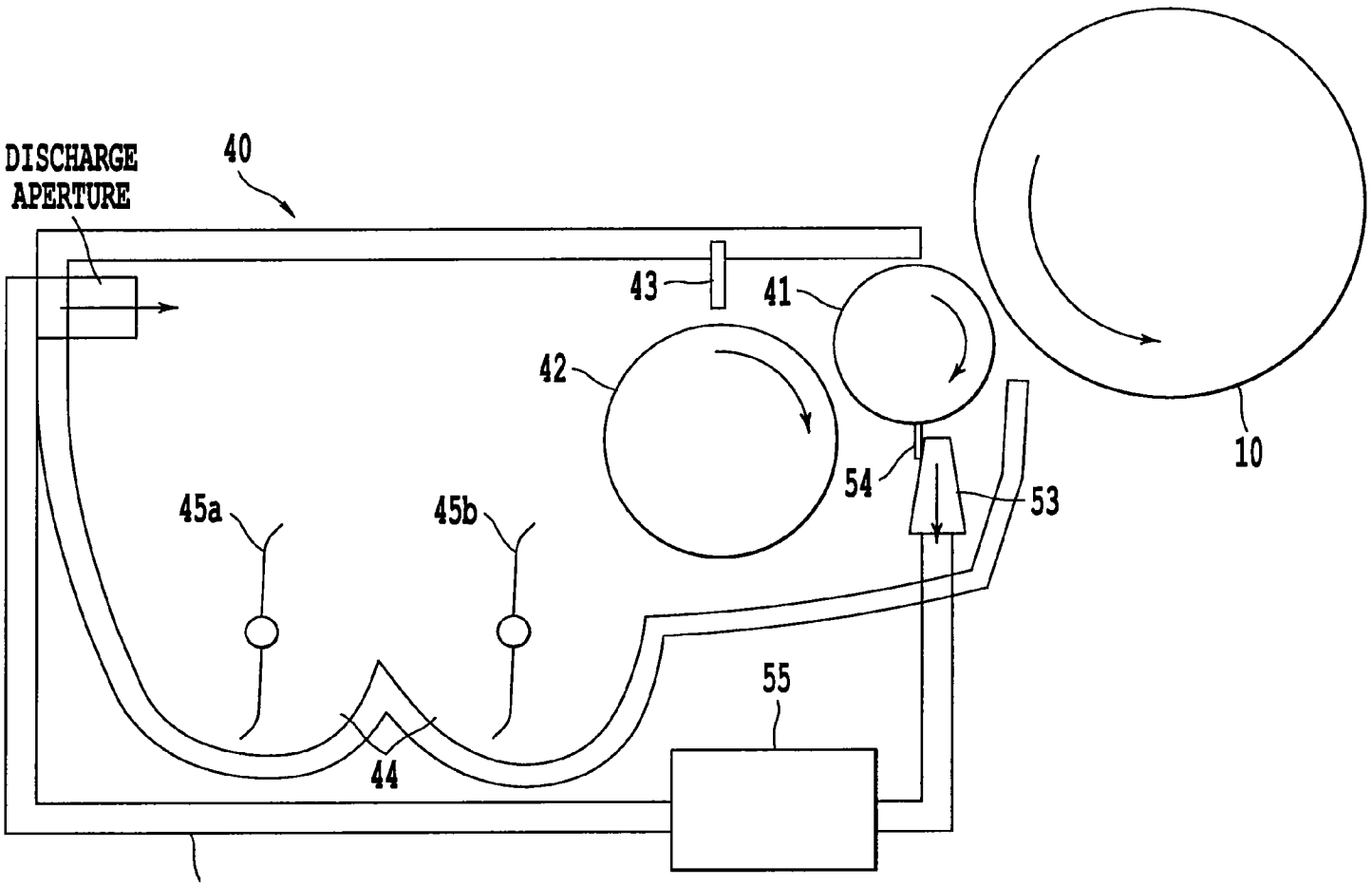
FIG. 10 is a diagram showing the schematic constitution of a developing device according to the sixth embodiment of the present invention.

Next, FIG. 10 is a diagram showing the schematic constitution of a developing device according to the present embodiment. Still another example of a developing device having toner recovery means disposed on the downstream side of the developing area relative to the direction of transport of the toner is shown. In a developing device 40 shown in FIG. 10, toner is recovered using a suction nozzle 53 as the toner recovery means. Specifically, the suction nozzle 53 is disposed in opposition to the toner carrier 41, and air is sucked from the suction nozzle 53 using a suction pump 55. A seal 54 is provided on the downstream side of the suction nozzle 53 in the direction of transport of toner, and the seal 54 contacts the surface of the toner carrier 41. In the recovery area, the toner that has not contributed to developing is entrained in the air current and recovered through the suction nozzle 53. Toner that is not entrained in the air current and that is transported by the progressive wave electric field impacts the seal 54, and cannot travel downstream. Toner recovered by the suction nozzle 53 is returned to the developing agent housing unit 44 via a duct 56.

Embodiment 7

Figure 11:
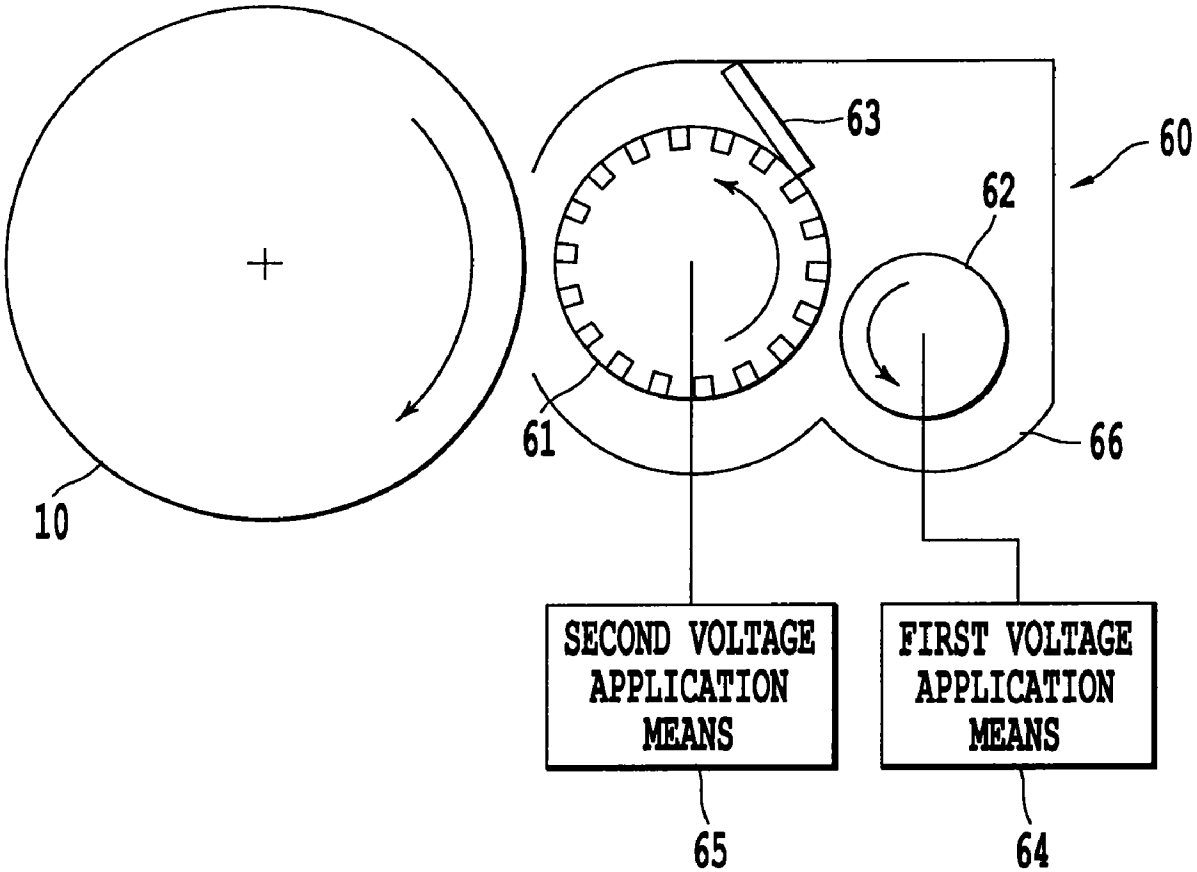
FIG. 11 is a diagram showing the schematic constitution of a developing device according to the seventh embodiment of the present invention.

Next, FIG. 11 is a diagram showing the schematic constitution of a developing device according to the seventh embodiment of the present invention. The developing device 60 uses one-component non-magnetic toner as the developing agent, and is constituted so that toner is directly supplied from a toner replenishment roller 62, which is a toner supply member, to a toner carrier 61. The constitution of the toner carrier 61 is the same as that of embodiment 1.

In the developing device 60 shown in FIG. 11, a sponge roller is used as the toner replenishment roller 62. The sponge roller 62 contacts the toner carrier 61 and charges the toner while supplying the toner to the toner carrier 61. In FIG. 11 the toner replenishment roller 62, which is a toner supply member, rotates in the same direction as the toner carrier 61, but the toner replenishment roller 62 may also rotate in the opposite direction to the toner carrier 61. A supply bias is applied to the sponge roller 62 by a first voltage application means 64, and using this voltage it is possible to control the quantity of toner supplied to the toner carrier 61. The supply bias may be a direct current voltage or an alternating current voltage. Also, the bias may be an alternating current voltage superimposed on a direct current voltage. A voltage is applied to the electrodes of the toner carrier 61 by second voltage application means 65. The voltage applied to the second voltage application means 65 is preferably a rectangular wave as shown in FIG. 2, but a sine wave or a triangular wave may also be used.

In the present embodiment, the electrodes have two phases as described previously, an a phase and a b phase, and the voltages applied to adjacent electrodes have a phase difference of $\pi$, which causes an electric field between the electrodes. The toner that has been supplied to the surface of the toner carrier 61 makes a reciprocating hopping motion between the electrodes due to the electric field between the electrodes. In the present embodiment, toner is transported as a result of rotation of the toner carrier 61. The toner supplied from the toner replenishment roller 62 to the toner carrier 61 is further charged and the quantity of toner is regulated by a toner layer control member 63.

The toner that has been charged and regulated by the toner layer control member 63 is further transported to the developing area by the rotation of the toner carrier 61. The toner that is transported to the developing area develops the latent image on a latent image carrier 10 by the developing electric field between the toner carrier 61 and the image part on the latent image carrier 10. The toner that has not contributed to the developing is further transported by the rotation of the toner carrier 61, and reaches the toner replenishment roller 62, which is a toner supply member. The toner supply roller 62 removes the toner that was returned without being used in developing from the toner carrier 61, and the toner is returned to the developing agent housing unit 66.

Next, examples that are common to the developing devices (20, 30, 40, 60) according to the embodiments 1 to 7 described above are explained.

Example 1

In the developing devices (20, 30, 40, 60) constituted as explained in embodiments 1 to 7 above, the developing area is defined as the area where the latent image carrier 10 is in opposition to the toner carrier (21, 31, 41, 61), and with the latent image carrier 10 in the stationary state the voltage of the image part is in opposition to the toner carrier (21, 31, 41, 61), toner is transported by the rotation of the toner carrier (21, 31, 41, 61), and the toner develops the latent image carrier 10. In the following the developing area is defined as the developing nip.

Also, in each of the embodiments, the supply area is defined as the area where toner is supplied to the toner carrier, by stopping the rotation of the toner carrier (21, 31, 41, 61) and applying a voltage to the toner supply member (22, 32, 42, 62) while no pulse voltage is applied to each of the electrodes.

Also, in the embodiments the regulation area is defined as the area where the toner carrier and the developing agent layer control member (or the toner layer control member) (23, 33, 43, 63) are in contact, with no toner on the toner carrier.

In the following, the present example is explained, taking the developing device 60 constituted as shown in FIG. 11 and explained in embodiment 7 as an example.

In the constitution of the developing device 60 of embodiment 7, the force F1 from the electric field between the electrodes and the adhesion force F2 that acts when the surface of the toner carrier 61 is in contact with the toner act on the toner on the surface of the toner carrier 61. If the width of the electrodes, the distance between electrodes, and the thickness of the insulation layer above the electrodes are the same on the toner carrier 61, the electric field between the electrodes on the whole peripheral surface of the toner carrier 61 is virtually the same, so F1 is the same. When the toner is passing the supply area and the regulation area, the toner is subjected to friction, and the toner becomes charged. The charged toner is subjected to image forces from the surface of the toner carrier 61. Also, when the regulation area is passed, the toner is subjected to pressure from the toner layer control member 63, and is pressed against the surface of the toner carrier 61. As a result of being pressed, the non-electrostatic adhesion forces between the toner and the toner carrier are increased. Therefore, after the toner has passed the regulation area the adhesion force F2 (the sum of the image force referred to above, then on-electrostatic forces, and so on) between the toner and the toner carrier 61 is at its maximum. If F1 is greater than F2, the toner can flare as a result of the electric field (hereafter referred to as the flaring electric field) formed on the surface of the toner carrier 61. If F1 is smaller than F2, the toner remains adhering to the surface of the toner carrier 61, and flaring is not possible. Therefore, F1 is made larger than F2 so that flaring occurs properly, by adjusting the voltage applied to the electrodes of the toner carrier 61, adjusting the amount of charge on the toner, or adjusting the additives added to the toner.

In the developing device 60 as described above, when the toner is not used very much during developing and continues to be circulated within the developing device, the toner degrades with time. Initially the toner matrix is covered by external additive, and there is no direct contact between the toner matrix and the toner carrier 61. After the toner has been circulated continuously within the developing device for some time, the external additive becomes separated from the matrix or becomes embedded in the matrix, so the percentage of external additive on the surface of the toner matrix is reduced. With this degraded toner, the toner matrix can come into direct contact with the surface of the toner carrier 61. When there is direct contact between the toner matrix and the surface of the toner carrier 61, the non-electrostatic forces and image forces between the toner and the surface of the toner carrier 61 increase, so F2 increases. If F2 becomes larger than F1 over time, flaring becomes impossible, and the toner cannot develop during the developing operation.

Therefore in the present invention a toner adhesion prevention member (first means) is provided upstream of the developing area relative to the direction of rotation of the toner carrier 61 to prevent adhesion between the toner and the surface of the toner carrier 61. The toner adhesion prevention member is an electrode provided in opposition to the toner carrier 61 and separated from the toner carrier 61 by a predetermined distance, and voltage application means (second means) for applying a voltage to the electrode is provided. Then by applying a voltage to the opposing electrode so that an electric field is generated in the direction from the toner adhering on the toner carrier 61 towards the opposing electrode, it is possible to increase F1 partially on the surface of the toner carrier 61. As a result F1 becomes larger than F2, and the toner starts to flare. The flared toner again contacts the surface of the toner, but it soon flares again because of the voltage switching, so the adhesion is not continuous. Also, even if there is toner for which F2 is greater than F1, as a result of impact with nearby toner that is hopping, the toner starts to move again, and can flare.

Next, a specific example of the toner adhesion prevention member provided in the developing device according to the present invention is described. In the following example, the constitution of the developing device is the same as the constitution of the developing device 60 in FIG. 11 as explained in embodiment 7. One-component non-magnetic toner is used as the developing agent. Toner is supplied directly from the toner replenishment roller 62, which is a toner supply member, to the toner carrier 61. However, the present invention is not limited to this, and a toner adhesion prevention member can also be provided in the developing devices constituted as explained in embodiments 1 to 6.

Figure 12:
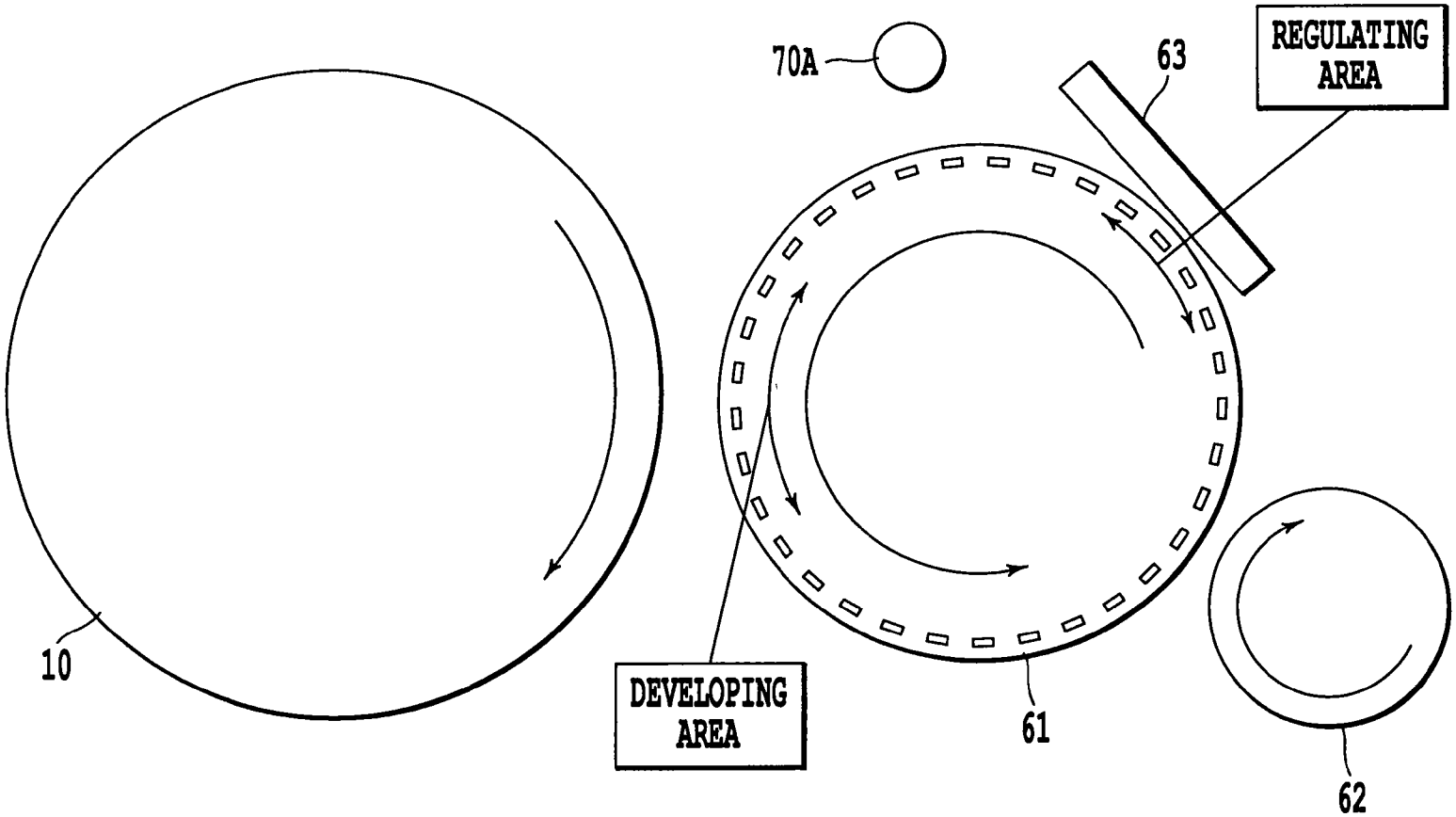
FIG. 12 is a diagram showing the schematic constitution of the main parts of a developing device according to an example of the present invention.

FIG. 12 is a schematic constitution of the main parts of a developing device according to an example of the present invention. This is an example of the constitution in which a toner adhesion prevention member is provided in the developing device 60 constituted as shown in FIG. 11. In FIG. 12, a toner adhesion prevention member 70A is a wire-shaped electrode stretched parallel to the direction of the axis of the toner carrier 61 (fifth means). In the case of a small developing device, there is not much space between the regulating area and the developing area, but a wire shaped electrode can be easily installed in a small developing device.

Figure 13:
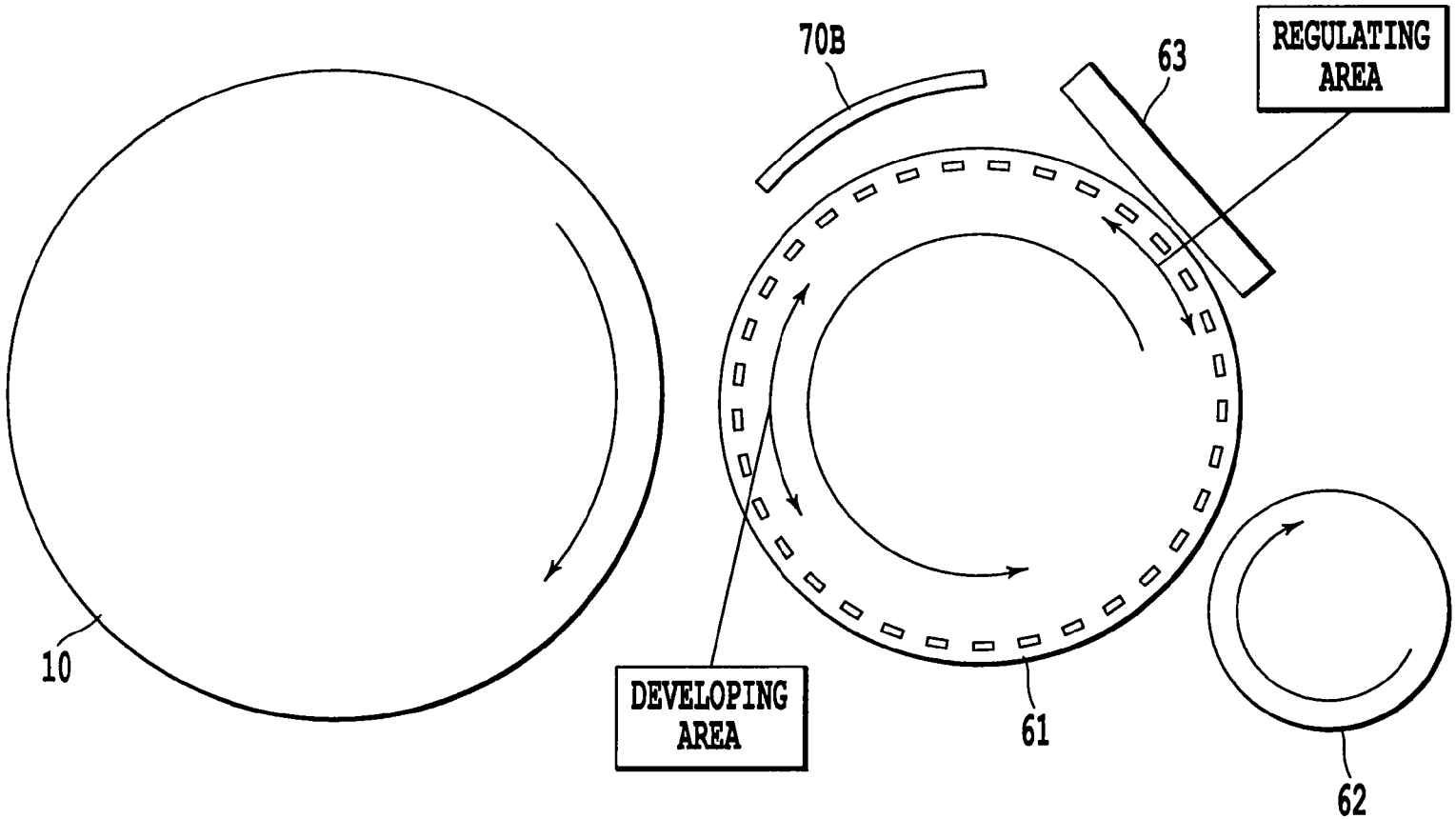
FIG. 13 is a diagram showing the schematic constitution of the main parts of a developing device according to another example of the present invention.

FIG. 13 is a diagram showing the schematic constitution of the main parts of a developing device according to another example of the present invention. This is another example of the constitution in which a toner adhesion prevention member is provided in the developing device 60 constituted as shown in FIG. 11. In the example in FIG. 13, a circular arc-shaped electrode that covers the surface of the toner carrier from the regulating area to the developing area is provided as a toner adhesion prevention member 70B (sixth means). In this way, it is possible to efficiently prevent toner adhesion by covering the surface of the toner carrier 61 using the circular arc-shaped electrode 70B over the wide area from the regulating area to the developing area.

The gap between the toner adhesion prevention member 70B and the toner carrier 61 is in the range 30 μm to 1 mm. The applied voltage may be either a direct current voltage (third means) or a voltage obtained by superimposing an alternating current voltage on a direct current voltage (fourth means). In the case of a direct current voltage, the value of the voltage applied is such that the voltage difference with V0 in FIG. 2 and FIG. 3 is in the range 30V to 300V. If a direct current voltage is used, the toner that is dispersed from the toner carrier 61 can be collected on the electrode. Also, in the case of an alternating current voltage, the direct current voltage component is the same as V0 in FIG. 2 and FIG. 3, and Vpp is in the range 100V to 1000V, and may be the same as the voltage Vpp applied to the electrodes of the toner carrier 61 or smaller. The frequency of the alternating current voltage is in the range 1 kHz to 10 kHz, and is set larger than the frequency of the voltage applied to the electrodes of the toner carrier 61. When an alternating current voltage is used, toner can be pulled from the toner carrier 61 by the oscillating electric field, so it is possible to efficiently prevent toner adhesion.

An other example of a toner adhesion prevention member is an electrically insulating member in direct contact with the toner carrier 61, constituted so as to prevent adhesion by moving toner adhering to the surface of the toner carrier (seventh means). With toner that has become degraded with time the adhesion force F2 between the toner and the toner carrier 61 increases so the toner remains adhering to the toner carrier 61 and flaring is not possible. However, by physically moving the adhering toner, the adhesion force F2 becomes smaller, and flaring becomes possible.

Figure 14:
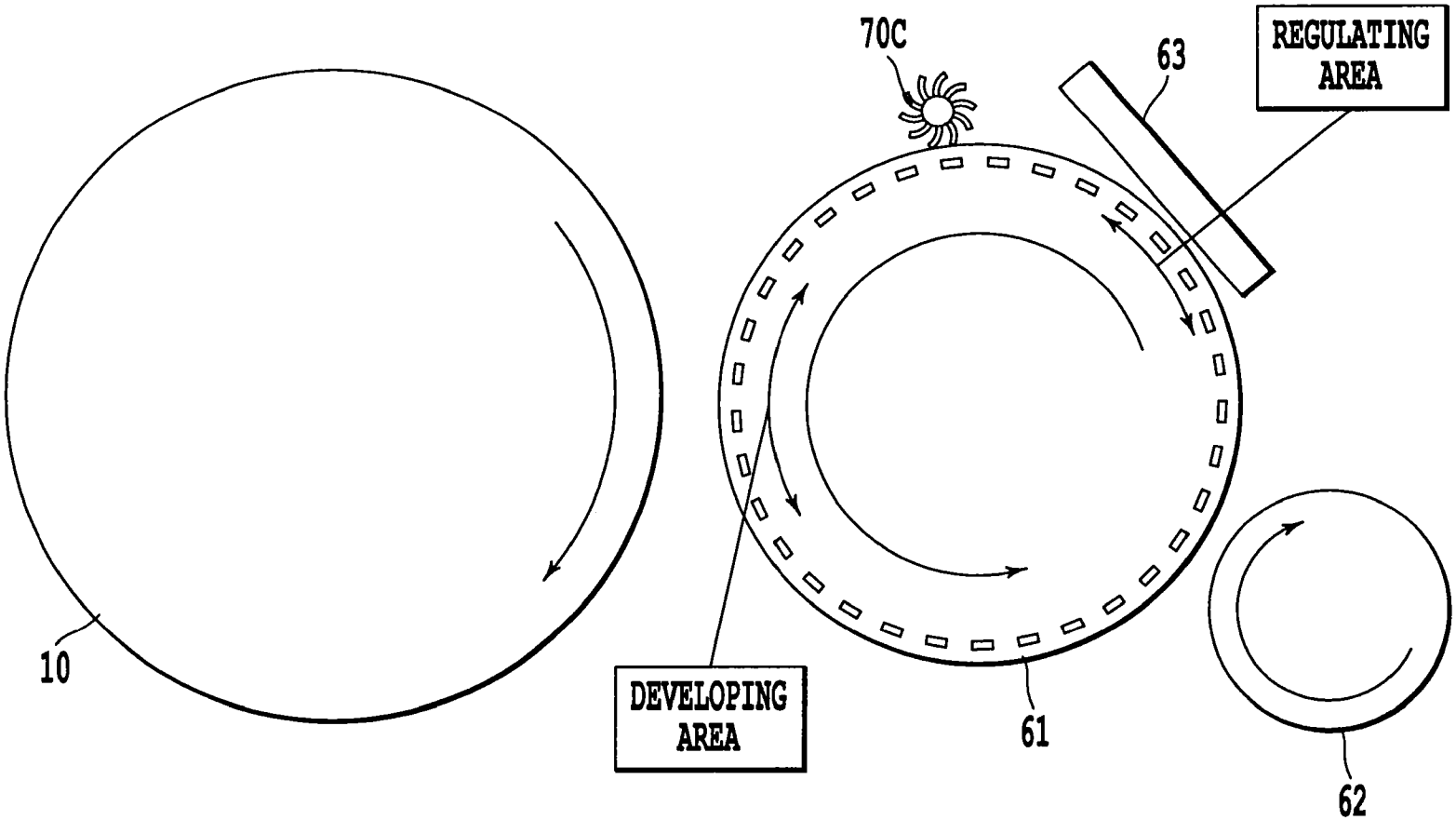
FIG. 14 is a diagram showing the schematic constitution of the main parts of a developing device according to another example of the present invention.
Figure 15:
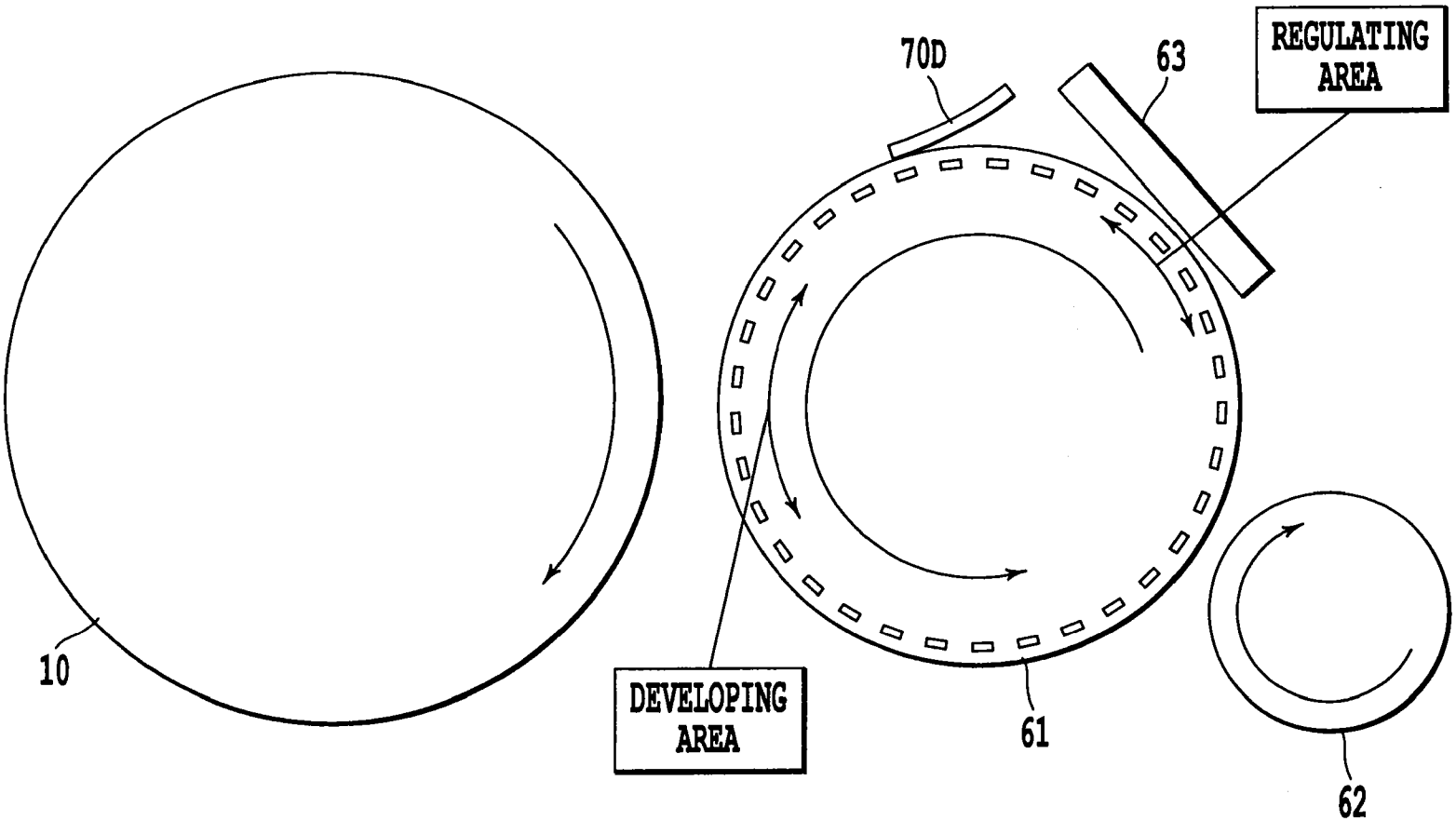
FIG. 15 is a diagram showing the schematic constitution of the main parts of a developing device according to another example of the present invention.

Here, FIG. 14 and FIG. 15 are examples that use electrically insulating members as the toner adhesion prevention members. FIG. 14 is an example in which an electrically insulating brush-shaped member 70C is provided as the toner adhesion prevention member. Also, FIG. 15 is an example in which an electrically insulating sheet-shaped member 70D is provided as the toner adhesion prevention member.

These electrically insulating toner adhesion prevention members 70C, 70D are indirect contact with the toner, so they affect the amount of charge on the toner, and so on. Therefore, while the toner is not adhering to the surface of the toner carrier but is flaring normally, it is desirable that the toner adhesion prevention member 70C, 70D does not contact the toner carrier 61. Therefore, the toner adhesion prevention member 70C, 70D is constituted so that it can contact and be separated from the toner carrier 61 (eighth means), and while the toner is normally flaring the toner adhesion prevention member 70C, 70D is separated from the toner carrier 61.

In the present example as described above, a toner adhesion prevention member that prevents adhesion of toner to the toner carrier 61 is provided upstream of the developing area of the toner carrier 61. An opposing electrode (70A or 70B) is provided in opposition to the toner carrier 61 as the toner adhesion prevention member. A voltage is applied to the electrode (70A or 70B) by voltage application means so that an electric field is generated to impel the toner in the direction from the toner carrier 61 towards the opposing electrode. Adhering toner is pulled from the toner carrier 61 and is made to flare. Also, by placing the electrically insulating brush-shaped member 70C or sheet-shaped member 70D as the toner adhesion prevention member in direct contact with the toner, the adhering toner is moved, the adhesion force is reduced, and the toner is allowed to flare. Therefore, according to the present invention, it is possible to prevent adhesion of toner to the toner carrier 61, and as a result it is possible to positively make the toner flare, and properly carry out developing in the developing area.

However, when there is no toner adhering to the surface of the toner carrier 61 and when the toner is flaring normally, it is not necessary to operate the toner adhesion prevention member (70A, 70B, 70C, 70D). Therefore, in the present invention, toner adhesion amount measurement means is provided, and the present invention is constituted so that the toner adhesion prevention member (70A, 70B, 70C, 70D) is operated using the measurement results of the toner adhesion measurement means (ninth means).

When adhesion of toner to the surface of the toner carrier 61 has not occurred and 100% of the image is developed, all the toner on the toner carrier 61 is used for developing, and there is no toner downstream of the developing area in the direction of rotation of the toner carrier 61. Also, the required amount of toner adheres to the latent image carrier 10 on the downstream side of the developing area in the direction of rotation of the latent image carrier 10. When adhesion of toner to the surface of the toner carrier 61 has occurred and 100% of the image is developed, the toner that is not adhering but is flaring normally is used in developing, but the toner that adheres to the surface of the toner carrier 61 is not used for developing, but remains adhering to the toner carrier 61. Therefore, there is toner on the toner carrier 61 on the downstream side of the developing area in the direction of rotation of the toner carrier 61.

Figure 16:
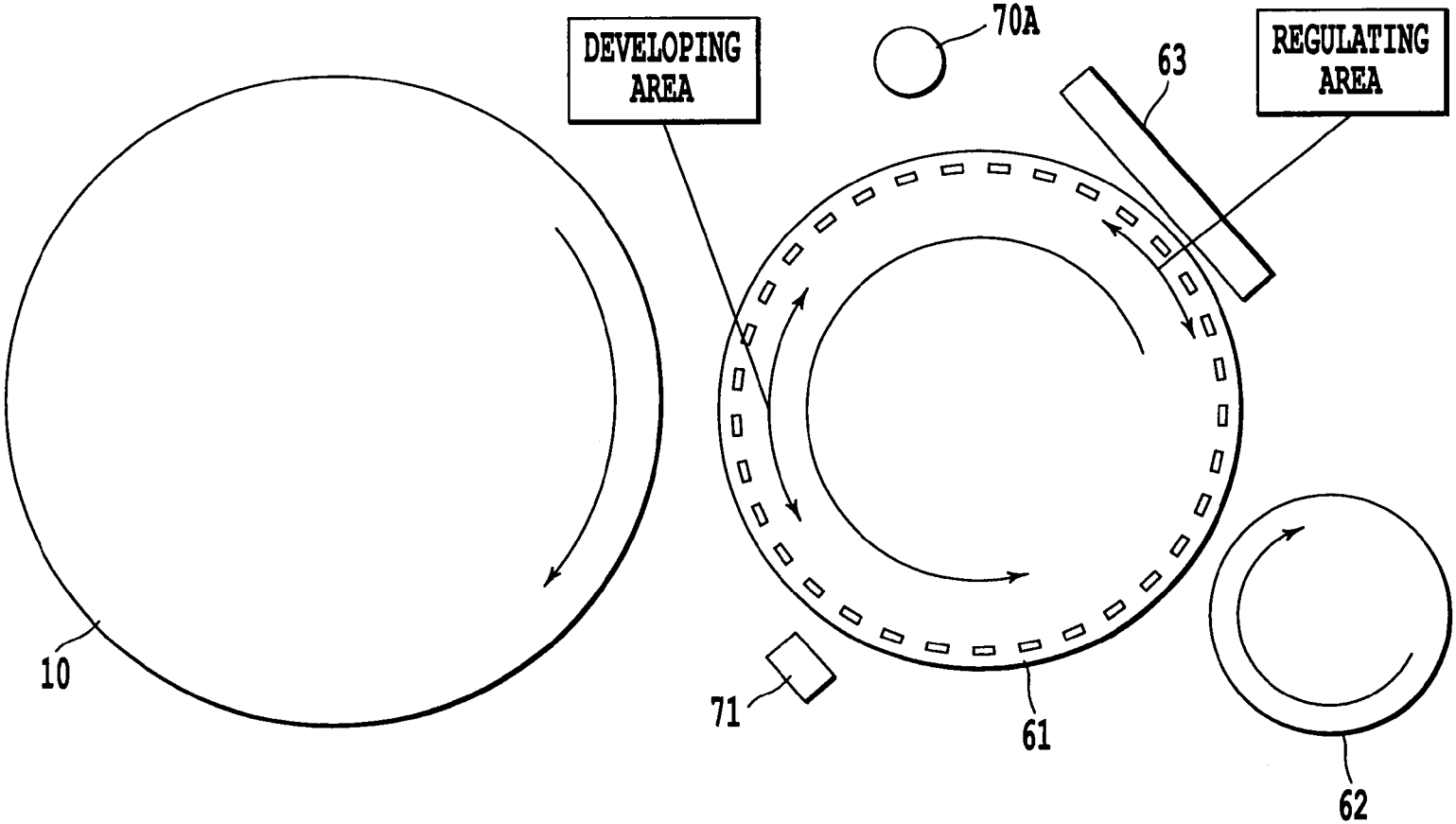
FIG. 16 is a diagram showing the schematic constitution of the main parts of a developing device according to another example of the present invention.
Figure 17:
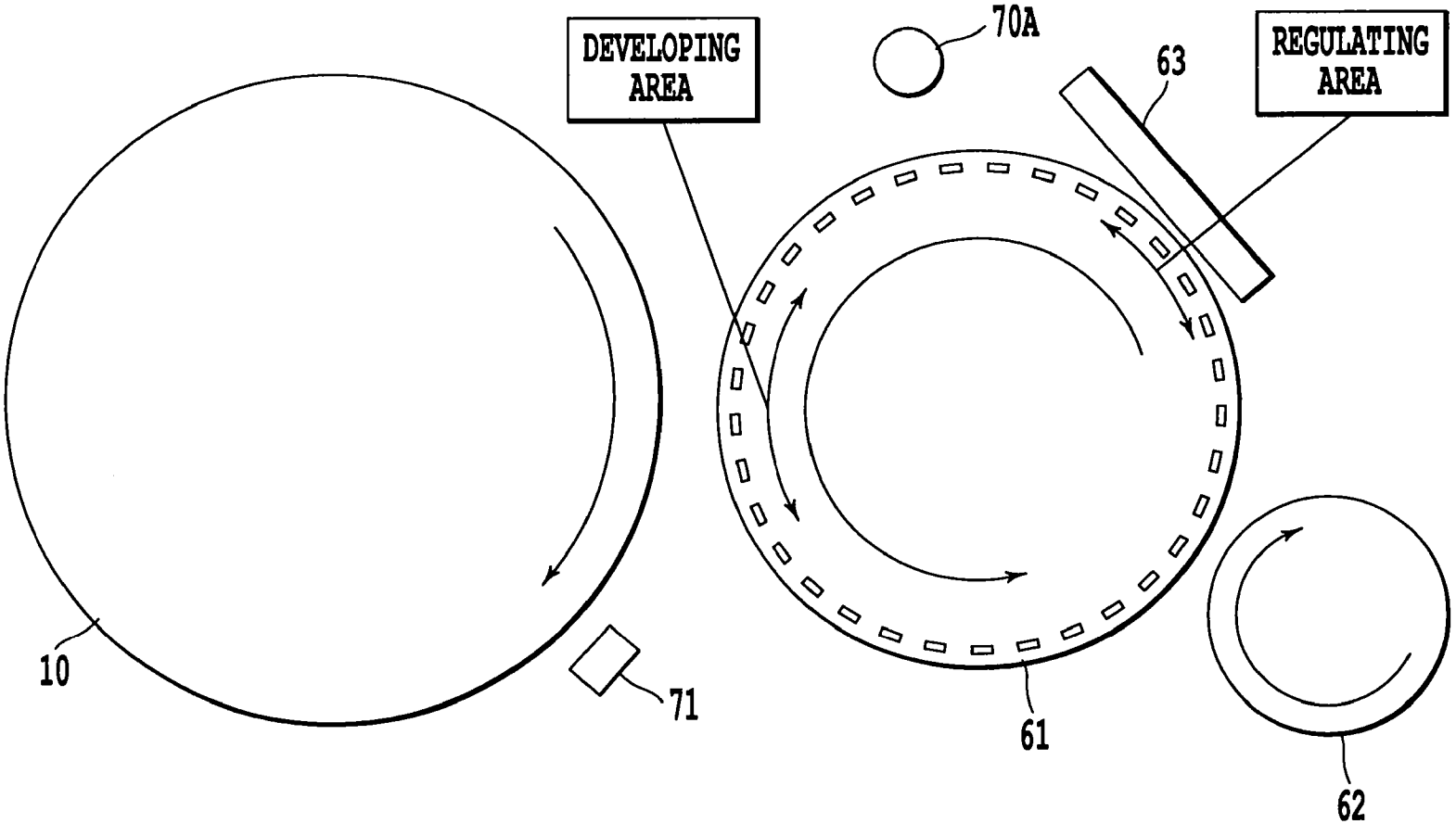
FIG. 17 is a diagram showing the schematic constitution of the main parts of a developing device according to another example of the present invention.

Also, on the latent image carrier 10, the amount of adhering toner becomes smaller on the downstream side of the developing area in the direction of rotation of the latent image carrier 10. Therefore, toner adhesion amount measurement means 71 is provided on the downstream side of the developing area, as shown in FIG. 16, in a position to measure the amount of toner adhering to the toner carrier 61, or, as shown in FIG. 17, is provided on the downstream side of the developing area in a position to measure the amount of toner adhering to the latent image carrier 10 (tenth means). Then it is possible to accurately measure the quantity of toner adhering to the surface of the toner carrier by measuring the quantity of toner adhering to the toner carrier 61 or to the latent image carrier 10, using the toner adhesion amount measurement means 71 provided in this type of position.

Here the toner adhesion amount measurement means 71 may be a reflection type optical sensor that includes a light emitting diode (LED) or similar light emitting optical element and a photodiode (PD) or similar light receiving optical element. The optical sensor may be either a reflected light detector or a dispersed light detector, but normally for color toner dispersed light is measured, and for black toner reflected light is measured.

When the amount of adhering toner measured by the toner adhesion amount measurement means 71 exceeds a predetermined value, the toner adhesion prevention member as described above is operated (when the toner adhesion prevention member is an electrode (70A or 70B) as shown in FIG. 12 or FIG. 13, it applies a voltage to the electrode, and when the toner adhesion prevention member is an electrically insulating member (70C or 70D) as shown in FIG. 14 or FIG. 15, it is separated from or brought into contact with the toner carrier), to prevent adhesion of toner to the surface of the toner carrier 61.

In the examples shown in FIG. 16 or FIG. 17 as described above, the toner adhesion amount measurement means 71 is provided to measure the amount of toner adhering to the toner carrier surface. Then the developing device is constituted so that the toner adhesion prevention member is operated using the measured results of the toner adhesion amount measurement means 71. Therefore, by using the measured results of the toner adhesion amount measurement means 71, it is possible to only operate the toner adhesion prevention member when adhesion of toner to the surface of the toner carrier has occurred.

Also, the toner adhesion amount measurement means 71 measures the amount of toner adhering to the toner carrier 61 downstream of the developing area, or the amount of toner adhering to the latent image carrier 10 downstream of the developing area. By measuring the amount of toner adhering to the toner carrier or the latent image carrier on the downstream side, it is possible to accurately measure the amount of toner adhering to the surface of the toner carrier. Therefore it is possible to reliably control the operation of the toner adhesion prevention member. The control of the operation of the toner adhesion prevention member based on the measurement results of the toner adhesion amount measurement means 71 is carried out by a control unit provided in the main body of the image forming apparatus.

Example 2

Next, an example of an image forming apparatus including the developing device as explained in example 1 above is explained.

Figure 18:
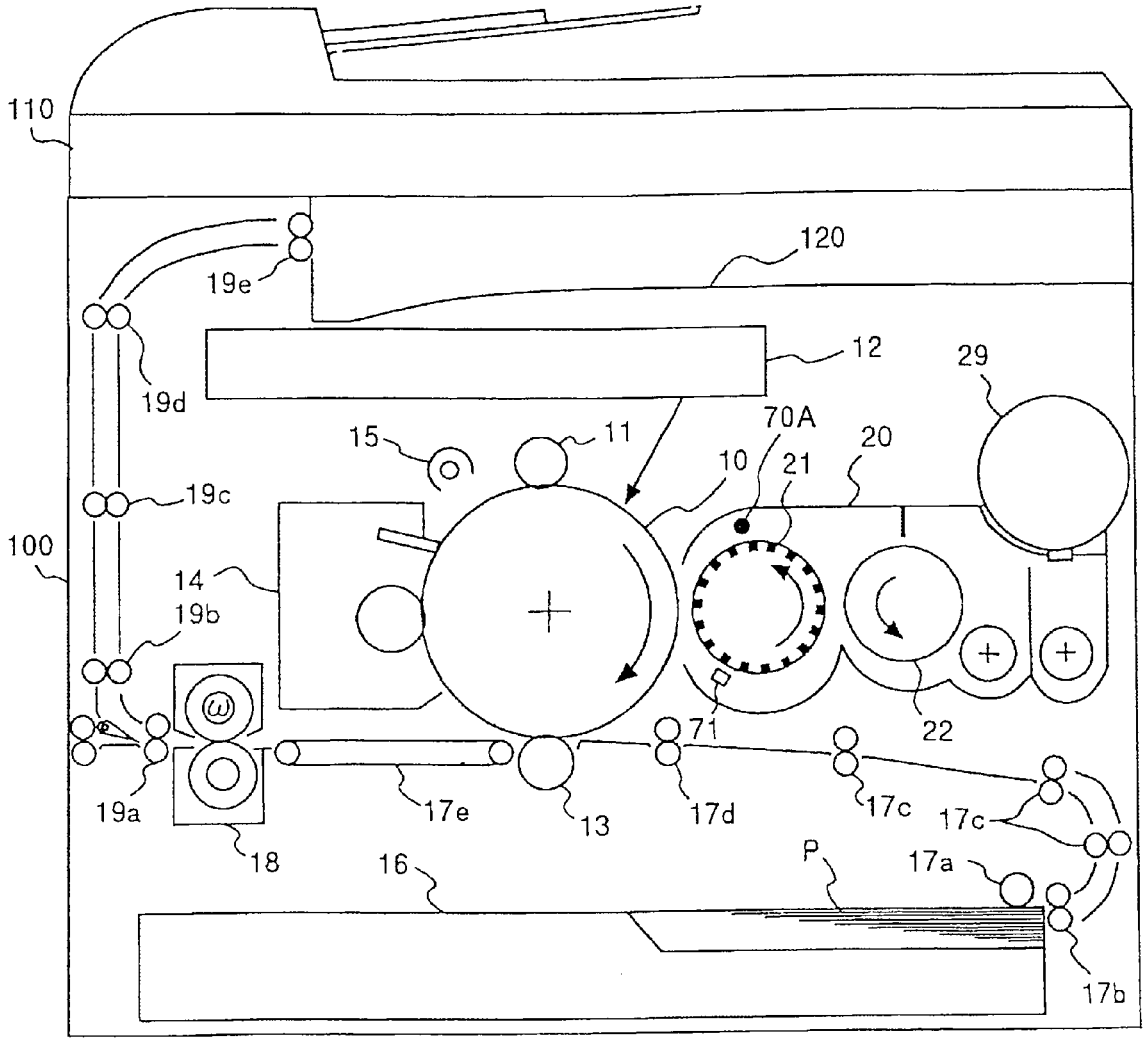
FIG. 18 is a diagram showing the schematic constitution of an example of an image forming apparatus that uses the developing device according to the present invention.

FIG. 18 is a diagram showing the schematic constitution of an example of an image forming apparatus that uses the developing device explained in example 1. An example of a digital photocopier (or a digital multi-function machine) is shown. The image forming apparatus includes an image forming unit (printer unit 100 and an image reading unit (scanner unit) 110. In the image forming unit (printer unit) 100, images are formed in accordance with image information of documents read by the image reading unit (scanner unit) 110, or image information input from a personal computer, or the like, external to the apparatus via a LAN, or image information transmitted from the outside via a communication circuit.

A drum-shaped photosensitive member 10, which is a latent image carrier, is disposed in approximately the center of the image forming unit (printer unit) 100. A charging device 11, an optical writing device 12, a developing device 20, a transfer device 13, a cleaning device 14, a decharging device 15, and so on, are disposed around the photosensitive member 10. The charging device 11 is for example a charging roller, a charging charger, a charging brush, or the like, that is charging means for charging the photosensitive member 10. The optical writing device 12 is for example a laser scanning type optical writing device, or a line type optical writing device that includes an LED array and a focusing element array. The optical writing device 12 illuminates the charged photosensitive member 10 with light based on image information. The developing device 20 develops the latent images on the photosensitive member 10 with toner to make them visible. The example shown in the figure is a developing device in which a toner adhesion prevention member 70A and a toner adhesion amount measurement means 71, and so on, are added to the developing device shown in FIG. 5. The transfer device 13 is for example a transfer roller, a transfer charger, a transfer brush, or the like, that transfers the toner image formed on the photosensitive member 10 to a recording material P. The cleaning device 14 is for example a cleaning blade, a cleaning brush, a cleaning roller, or the like, that removes toner remaining on the photosensitive member 10 after transfer. The decharging device 15 is for example a decharging lamp, a decharging charger, a decharging brush, or the like, that removes the remaining charge from the photosensitive member 10. Also, a toner housing unit 29 is provided on the top of the developing device 20, and toner is replenished to the developing agent housing unit from the toner housing unit 29 via a toner replenishment aperture.

When image forming starts the image forming operation is executed using the electrophotographic process. The photosensitive member 10 rotates in the clockwise direction as indicated by the arrow in the drawing, and the surface of the photosensitive member 10 is uniformly charged by the charging device 11. Then the optical writing device 12 illuminates the charged photosensitive member 10 with light in accordance with image information to form an electrostatic latent image. The electrostatic latent image is developed by toner carried by a toner carrier 21 of the developing device 20, and made visible as a toner image.

A sheet supply cassette 16 that houses recording material P such as recording sheets and the like is mounted on the lower part of the image forming unit 100. Recording material P within the sheet supply cassette 16 is supplied one sheet at a time by a sheet supply roller 17*a* and a separation roller 17*b*, in accordance with the timing of the image forming operation. The recording material P is transported through a plurality of transport rollers 17*c* to a registration roller 17*d*. Then, the recording material P is fed to the transfer position by the registration roller 17*d* at the timing that the toner image on the photosensitive member 10 arrives at the transfer position, and the toner image on the photosensitive member 10 is transferred to the recording material P by the transfer device 13. The recording material P onto which the toner image has been transferred passes a transport belt 17*e* and is transported to a fixing device 18. At the fixing device 18 the toner image is heated and pressurized by the fixing device 18 and fixed to the recording material P. After fixing, the recording material P passes through a plurality of sheet discharge rollers 19*a* to 19*e*, and is discharged into a sheet discharge tray 120. Also, after transfer of the toner image, residual toner is removed from the photosensitive member 10 by the cleaning device 14, and residual charge is removed by the decharging device 15.

In the image forming apparatus according to the present example, a developing device constituted as explained in example 1 is provided as means for developing the latent image on the photosensitive member 10. Therefore it is possible to prevent adhesion of toner to the toner carrier, and as a result it is possible to make the toner flare reliably. Therefore, developing is carried out properly in the developing area, so it is possible to prevent faulty images due to adhering toner, and stable good quality image forming can be carried out.

Example 3

Next, an example of process cartridge that includes the developing device as explained in example 1 is explained. In the image forming apparatus as described in example 2 above, it is possible to use a process cartridge in which at least one of the photosensitive member, the charging device, and the cleaning device is integrated with the developing device.

Figure 19:
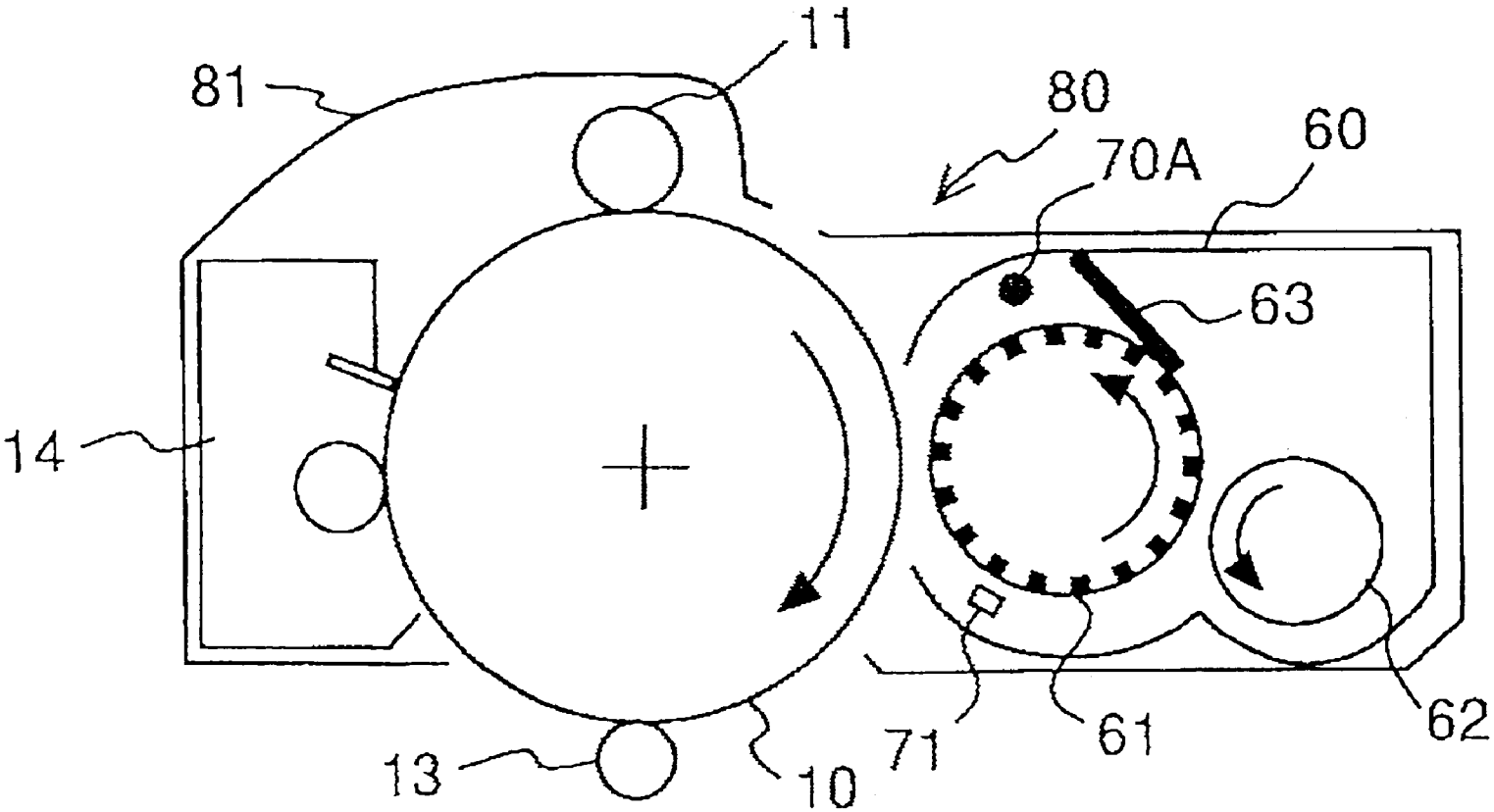
FIG. 19 is a cross-section diagram showing an example of the constitution of a process cartridge that uses the developing device according to the present invention.

FIG. 19 is a schematic cross-section diagram showing an example of a process cartridge. The process cartridge 80 includes a photosensitive member 10, a charging device 11, a developing device 60 (the example shown in the drawing is a developing device in which a toner adhesion prevention member 70A and toner adhesion amount measurement means 71, and so on of the example 1, are added to the developing device shown in FIG. 11), and a cleaning device 14 integrated within a cartridge 81. The process cartridge 80 is provided so that it can be attached to and removed from the image forming apparatus. Therefore the process cartridge 80 can be easily changed or recycled, the maintainability of the image forming apparatus can be improved, and it is possible to contribute to economizing on resource utilization.

Example 4

Next an example of image forming apparatus that includes the process cartridge as explained in example 3 is explained.

Figure 20:
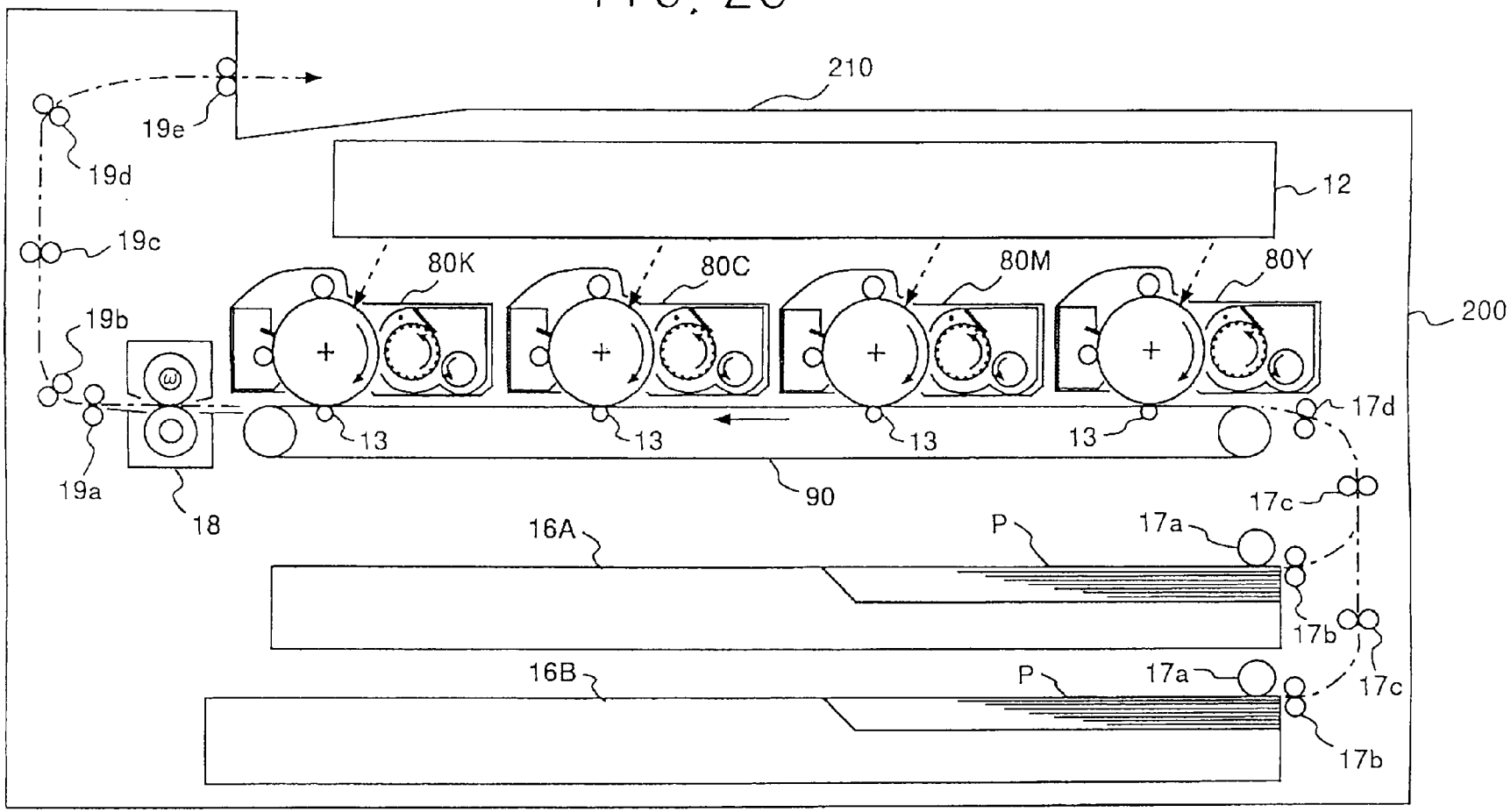
FIG. 20 is a diagram showing an example of the constitution of a color image forming apparatus that includes a plurality of the process cartridges shown in FIG. 19.

FIG. 20 is a schematic diagram showing an example of the constitution of a color image forming apparatus that forms monochrome, multi-color, or full color images and that includes a plurality of the process cartridges 80 shown in FIG. 19.

In the image forming apparatus 200, four process cartridges 80Y, 80M, 80C, 80K are disposed along a transfer belt 90 that transports recording material P. The process cartridge 80Y forms yellow toner images on the photosensitive member using the electrophotographic process, the same as that shown in example 9. The process cartridge 80M forms magenta toner images on the photosensitive member using the electrophotographic process, the same as that shown in example 9. The process cartridge 80C forms cyan toner images on the photosensitive member using the electrophotographic process, the same as that shown in example 9. The process cartridge 80K forms black toner images on the photosensitive member using the electrophotographic process, the same as that shown in example 9.

A multi-stage sheet supply cassette 16A, 16B that houses recording material P such as recording sheets and the like is fitted below the transfer belt 90. The recording material P is fed one sheet at a time from one of the sheet supply cassettes 16A, 16B by the sheet supply roller 17*a* and separation roller 17*b*, in accordance with the timing of the image forming operation in each of the process cartridges 80Y, 80M, 80C, 80K. The recording material P is then transported through a plurality of transport rollers 17*c* to a registration roller 17*d*. The registration roller 17*d* feeds the recording material P to the transfer belt 90 at a timing that is consistent with the arrival of the toner images on the photosensitive members of each process cartridge 80Y, 80M, 80C, 80K at the transfer positions. The recording material P is transported successively to the transfer positions of each of the process cartridges 80Y, 80M, 80C, 80K by the transfer belt 90, and the toner images in each color on the photosensitive members are transferred successively and superimposed on the recording material P by each transfer device 13. The recording material P onto which the toner images have been transferred is transferred to a fixing device 18 by the transport belt 17*e*. The toner image is heated and pressurized by the fixing device 18 to fix the toner image onto the recording material P. The recording material P after fixing is discharged through a plurality of discharge rollers 19*a* to 19*e*, and discharged in a sheet discharge tray 210. Also, after transfer of the toner images the photosensitive members 10 of each process cartridge 80Y, 80M, 80C, 80K are cleaned of residual toner by cleaning devices 14.

In the color image forming apparatus 200 constituted as described above, it is possible to stably form good monochrome, multi-color, or full color images by selectively operating each process cartridge 80Y, 80M, 80C, 80K. Also, each process cartridge 80Y, 80M, 80C, 80K is provided so that they can be attached to and removed from the image forming apparatus. Therefore the process cartridges 80Y, 80M, 80C, 80K can be easily changed or recycled, the maintainability of the image forming apparatus can be improved, it is possible to contribute to economizing on resource utilization, and the color image forming apparatus 200 can be easily maintained and controlled.

In FIG. 20, an example of the constitution of a direct transfer tandem type color image forming apparatus is shown in which four process cartridges 80Y, 80M, 80C, 80K are disposed in a line along the transfer belt 90 that transports the recording material P. However, an intermediate transfer belt may be used instead of the transfer belt 90. If a secondary transfer unit for secondary transfer from the intermediate transfer belt to the recording material is provided, it is possible to constitute an intermediate transfer tandem type color image forming apparatus.

Also, FIG. 20 only shows the constitution of the printer unit. However, by providing an image writing unit (scanner unit) above the printer unit, as in FIG. 18, it is possible to constitute a multi-purpose machine that functions as a printer or digital photocopier. Also, by connecting the image forming apparatus to a communication circuit, the image forming apparatus can be used as a facsimile machine.

As explained above, in the present invention, a toner adhesion prevention member that prevents adhesion of toner to the toner carrier is provided upstream of the developing area of the toner carrier. Also, an opposing electrode is provided in opposition to the toner carrier as the toner adhesion prevention member. A voltage is applied to the electrode to generate an electric field to impel the toner from the toner carrier in the direction of the opposing electrode. In this way adhering toner is pulled from the toner carrier, and allowed to flare. Also, by bringing an electrically insulating brush-shaped member or sheet-shaped member as toner adhesion prevention member into direct contact with toner adhering to the toner carrier, the adhering toner is moved, the adhesion force is reduced, and the toner is allowed to flare.

More specifically, in the developing device of the first means, a toner adhesion prevention member is provided upstream of the developing area where the latent image carrier and the toner carrier are in opposition, to prevent adhesion of toner to the surface of the toner carrier. Therefore it is possible to prevent adhesion of toner to the toner carrier, and as a result it is possible for the toner to flare reliably, so developing can be carried out properly in the developing area.

In the developing device of the second means, in addition to the constitution and effect of the first means, the toner adhesion prevention member is an electrode, and voltage application means is provided for applying a voltage to the electrode. Therefore by using a non-contacting electrode in opposition to the toner carrier, it is possible to prevent adhesion of toner without affecting the amount of charge on the toner, and so on.

Also, in the developing device of the third means, in addition to the constitution and effect of the second means, the voltage applied by the voltage application means is a direct current voltage. Therefore by applying a direct current voltage to the electrode, it is possible to prevent adhesion of toner, as well as collect dispersed toner.

Further, in the developing device of the fourth means, in addition to the constitution and effect of the second means, the voltage applied by the voltage application means is a voltage obtained by superimposing an alternating current voltage on a direct current voltage. Therefore by applying, to the electrode, a voltage obtained by superimposing an alternating current voltage on a direct current voltage, an oscillating electric field acts on the toner, so it is possible to efficiently prevent adhesion of toner.

In the developing device of the fifth means, in addition to the constitution and effect of any of the first to fourth means, the toner adhesion prevention member is a wire-shaped electrode. Therefore, by making the electrode from wire, the electrode can easily be installed in the narrow space of a small developing device.

Also, in the developing device of the sixth means, in addition to the constitution and effect of any of the first to fourth means, the toner adhesion prevention member is a circular arc-shaped electrode. Therefore by making the electrode in a circular arc shape, it is possible to remove the adhering toner from the surface of the toner carrier over a wide area.

In the developing device of the seventh means, in addition to the constitution and effect of the first means, the toner adhesion prevention member is an electrically insulating member that contacts the toner carrier to move the toner adhering to the surface of the toner carrier. Therefore, by making the electrically insulating member contact the surface of the toner carrier, it is possible to positively move the toner adhering to the surface of the toner carrier, so it is possible to efficiently prevent adhesion of toner.

Also, in the developing device of the eighth means, in addition to the constitution and effect of the first or seventh means, it is possible for the toner adhesion prevention member to be separated from or brought into contact with the toner carrier. Therefore, by making it possible for the toner adhesion prevention member to be separated from or brought into contact with the toner carrier, the toner adhesion prevention member does not contact the toner when toner adhesion has not occurred. Therefore the amount of charge on the toner is not affected.

Also, in the developing device of the ninth means, in addition to the constitution and effect of any of the first to eighth means, toner adhesion amount measurement means is provided to measure the amount of toner adhering to the surface of the toner carrier. The toner adhesion prevention member is operated using the measurement results of the toner adhesion amount measurement means. Therefore, by using the measurement results of the toner adhesion amount measurement means, the toner adhesion prevention member may be operated only when adhesion of toner to the surface of the toner carrier has occurred.

Also, in the developing device of the tenth means, in addition to the constitution and effect of any of the first to ninth means, the toner adhesion amount measurement means measures the amount of toner adhering to the toner carrier downstream of the developing area, or the amount of toner adhering to the latent image carrier downstream of the developing area. Therefore, by measuring the amount of toner adhering to the toner carrier or the latent image carrier downstream of the developing area, it is possible to accurately measure the amount of toner adhering to the surface of the toner carrier.

In the image forming apparatus of the eleventh means, a developing device according to any one of the first to tenth means is provided as means for developing the latent images on the latent image carrier. Therefore the effect of anyone of the first to tenth means can be obtained, it is possible to prevent faulty images due to adherence of toner, and good, stable image forming can be carried out.

Also, in the image forming apparatus of the twelfth means, in addition to the effect of the eleventh means, it is possible to carry out good, stable multi-color or full color image forming by an image obtained by superimposing the plurality of toner images formed on the latent image carriers on the recording material.

In the process cartridge of the thirteenth means, at least one of the latent image carrier, the charging means, and the cleaning means is supported integrally with any one of the developing devices according to the first to tenth means. Therefore, it is possible to prevent faulty images due to adherence of toner, and it is possible to provide a process cartridge capable of carrying out good, stable image forming. Also, the process cartridge is capable of being attached to and removed from the image forming apparatus, so changing or recycling the process cartridge is easy, the maintainability of the image forming apparatus can be improved, and it is possible to contribute to reduction of resource utilization.

In the image forming apparatus of the fourteenth means, either a single or a plurality of process cartridges of the thirteenth means are provided to form monochrome, multi-color, or full color images. Therefore, it is possible to form good, stable monochrome, multi-color, or full color images. Also, the process cartridge is capable of being attached to and removed from the image forming apparatus, so changing or recycling the process cartridge is easy, the maintainability of the image forming apparatus can be improved, and it is possible to contribute to reduction of resource utilization. Also, maintenance and control of the image forming apparatus is simplified.

Various modifications will become possible for those skilled in the art after receiving the teachings of the present disclosure without departing from the scope thereof.

What is claimed is:

1. A developing device for developing an electrostatic latent image on a latent image carrier, the developing device comprising:

a toner carrier which is disposed in opposition to the latent image carrier and which carries toner to a developing area;

a plurality of electrodes aligned at predetermined intervals within the toner carrier;

a toner layer control member provided in opposition to the toner carrier for regulating the toner on the toner carrier to a constant thickness;

a voltage application means for applying a voltage to the plurality of electrodes so that an electric field between the plurality of electrodes varies with time, wherein the electric field between the plurality of electrodes causes the toner on the toner carrier to hop and form a cloud;

a toner adhesion prevention member that is provided upstream of the developing area where the latent image carrier is in opposition to the toner carrier and downstream of a regulation area where the toner carrier is in opposition to the toner layer control member and that prevents adhesion of toner to the toner carrier; and a toner adhesion amount measurement means for measuring the amount of toner adhering to the surface of the toner carrier, wherein the toner adhesion prevention member is operated using the measurement results of the toner adhesion amount measurement means so as to decrease the amount of toner adhering to the surface of the toner carrier when the amount of toner from the measurement results exceeds a predetermined value.

2. The developing device as claimed in claim 1, wherein the toner adhesion prevention member is an electrode, and a second voltage application means for applying a voltage to the electrode of the toner adhesion prevention member is provided.

3. The developing device as claimed in claim 2, wherein the voltage applied by the second voltage application means is a direct current voltage.

4. The developing device as claimed in claim 2, wherein the voltage applied by the second voltage application means is a voltage obtained by superimposing an alternating current voltage on a direct current voltage.

5. The developing device as claimed in claim 1, wherein the toner adhesion prevention member is a wire-shaped electrode.

6. The developing device as claimed in claim 1, wherein the toner adhesion prevention member is a circular-arc-shaped electrode.

7. The developing device as claimed in claim 1, wherein the toner adhesion prevention member is an electrically insulating member in contact with the toner carrier, and moves the toner that adheres to the surface of the toner carrier.

8. The developing device as claimed in claim 1, wherein the toner adhesion prevention member can be separated from or brought into contact with the toner carrier.

9. The developing device as claimed in claim 1, wherein the toner adhesion amount measurement means is a reflection-type optical sensor.

10. The developing device as claimed in claim 9, wherein the reflection-type optical sensor includes a light emitting diode.

11. The developing device as claimed in claim 9, wherein the reflector-type optical sensor includes a photo diode.

12. The developing device as claimed in claim 1, wherein the toner adhesion amount measurement means is a dispersed light detector.

13. The developing device as claimed in claim 1, further comprising a toner supply member for supplying toner to the toner carrier.

14. The developing device as claimed in claim 1, wherein a gap between the toner adhesion prevention member and the toner carrier is between 30 μm and 1 mm.

15. An image forming apparatus that forms an image by developing a latent image on a latent image carrier by causing toner to adhere to the latent image, and finally transferring a toner image obtained in this development process to a recording material, the image forming apparatus comprising a developing device for developing the latent image on the latent image carrier, wherein the developing device has a toner carrier which is disposed in opposition to the latent image carrier and which carries toner for developing an electrostatic latent image on the latent image carrier, and comprises:

a plurality of electrodes aligned at predetermined intervals within the toner carrier;

a toner layer control member provided in opposition to the toner carrier for regulating the toner on the toner carrier to a constant thickness;

a voltage application means for applying a voltage to the plurality of electrodes so that an electric field between the plurality of electrodes varies with time, wherein the electric field between the plurality of electrodes causes the toner on the toner carrier to hop and form a cloud;

a toner adhesion prevention member that is provided upstream of a developing area where the latent image carrier is in opposition to the toner carrier and downstream of a regulation area where the toner carrier is in opposition to the toner layer control member and that prevents adhesion of toner to the toner carrier; and a toner adhesion amount measurement means for measuring the amount of toner adhering to the surface of the toner carrier, wherein the toner adhesion prevention member is operated using the measurement results of the toner adhesion amount measurement means so as to decrease the amount of toner adhering to the surface of the toner carrier when the amount of toner from the measurement results exceeds a predetermined value.

16. The image forming apparatus as claimed in claim 15, wherein an image obtained by superimposing a plurality of toner images formed on the latent image carrier is formed on a recording material.

17. A process cartridge mounted on an image forming apparatus that forms an image by an electrophotographic process, wherein at least one of a latent image carrier, charging means, and cleaning means is supported integrally with a developing device, and the process cartridge is capable of being attached to and removed from the image forming apparatus, wherein the developing device has a toner carrier which is disposed in opposition to the latent image carrier and which carries toner for developing an electrostatic latent image on the latent image carrier, and comprises:

a plurality of electrodes aligned at predetermined intervals within the toner carrier;

a toner layer control member provided in opposition to the toner carrier for regulating the toner on the toner carrier to a constant thickness;

a voltage application means for applying a voltage to the plurality of electrodes so that an electric field between the plurality of electrodes varies with time, wherein the electric field between the plurality of electrodes causes the toner on the toner carrier to hop and form a cloud;

a toner adhesion prevention member that is provided upstream of a developing area where the latent image carrier is in opposition to the toner carrier and downstream of a regulation area where the toner carrier is in opposition to the toner layer control member and that prevents adhesion of toner to the toner carrier; and a toner adhesion amount measurement means for measuring the amount of toner adhering to the surface of the toner carrier, wherein the toner adhesion prevention member is operated using the measurement results of the toner adhesion amount measurement means so as to decrease the amount of toner adhering to the surface of the toner carrier when the amount of toner from the measurement results exceeds a predetermined value.

18. An image forming apparatus that forms an image by an electrophotographic process and that comprises one or a plurality of process cartridges to form a monochrome, multicolor, or full color image, wherein each process cartridge is mounted on the image forming apparatus, has at least one of a latent image carrier, charging means, and cleaning means supported integrally with a developing device, and is capable of being attached to and removed from the image forming apparatus, and wherein the developing device has a toner carrier which is disposed in opposition to the latent image carrier and which carries toner for developing an electrostatic latent image on the latent image carrier, and comprises:

a plurality of electrodes aligned at predetermined intervals within the toner carrier;

a toner layer control member provided in opposition to the toner carrier for regulating the toner on the toner carrier to a constant thickness;

a voltage application means for applying a voltage to the plurality of electrodes so that an electric field between the plurality of electrodes varies with time, wherein the electric field between the plurality of electrodes causes the toner on the toner carrier to hop and form a cloud;

a toner adhesion prevention member that is provided upstream of a developing area where the latent image carrier is in opposition to the toner carrier and downstream of a regulation area where the toner carrier is in opposition to the toner layer control member and that prevents adhesion of toner to the toner carrier; and a toner adhesion amount measurement means for measuring the amount of toner adhering to the surface of the toner carrier, wherein the toner adhesion prevention member is operated using the measurement results of the toner adhesion amount measurement means so as to decrease the amount of toner adhering to the surface of the toner carrier when the amount of toner from the measurement results exceeds a predetermined value.

* * * * *